US012258190B2

(12) United States Patent
Walling et al.

(10) Patent No.: US 12,258,190 B2
(45) Date of Patent: Mar. 25, 2025

(54) ARTICLE CARRIER AND BLANK THERFOR

(71) Applicant: WestRock Packaging Systems, LLC, Atlanta, GA (US)

(72) Inventors: Bradford J. Walling, Chesterfield, VA (US); Matthew E. Zacherle, Moseley, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/625,761

(22) PCT Filed: Jul. 7, 2020

(86) PCT No.: PCT/US2020/041003
§ 371 (c)(1),
(2) Date: Jan. 9, 2022

(87) PCT Pub. No.: WO2021/007206
PCT Pub. Date: Jan. 14, 2021

(65) Prior Publication Data

US 2022/0297912 A1 Sep. 22, 2022

Related U.S. Application Data

(60) Provisional application No. 62/885,990, filed on Aug. 13, 2019, provisional application No. 62/885,445,
(Continued)

(51) Int. Cl.
*B65D 71/42* (2006.01)

(52) U.S. Cl.
CPC ..... *B65D 71/42* (2013.01)

(58) Field of Classification Search
CPC ..... B65D 71/40; B65D 71/42; B65D 71/50
(Continued)

(56) References Cited

U.S. PATENT DOCUMENTS 4,911,290 A * 3/1990 Karabedian ..... B65D 71/50 206/161
5,065,862 A * 11/1991 Mousseau ..... B65D 71/50 206/150

(Continued)

FOREIGN PATENT DOCUMENTS

CN 101610956 A 12/2009
CN 109328171 A 2/2019

(Continued)

OTHER PUBLICATIONS

Chinese Office Action and Search Report of Apr. 19, 2023, issued during the prosecution of corresponding Patent Application No. 2020800628175.

(Continued)

*Primary Examiner* — Bryon P Gehman
(74) *Attorney, Agent, or Firm* — Brian J. Goldberg; Rohini K. Garg

(57) ABSTRACT

Aspects of the disclosure relate to a top engaging article carrier (90) for packaging one or more articles (B) and a blank (10, 110, 210, 310, 410, 510) for forming the carrier. The top-engaging article carrier comprises an engaging panel having an upper panel (12A) and a lower panel (12B) disposed in face to face contacting relationship with each other. The article carrier comprises a top engaging device (RT) comprising a first article receiving opening (A1) in the lower panel and a second article receiving opening (A2) in the upper panel. The first article receiving opening comprises a first diameter (d1). The second article receiving opening comprises a second diameter (d2). The first diameter is greater than the second diameter. The article comprises: an upper end, having an end diameter (Cd); a main body, having a body diameter (Bd); and a neck disposed therebetween and having a neck diameter (Nd). The first
(Continued)

diameter is equal to or greater than the end diameter (d1≥Cd).

19 Claims, 14 Drawing Sheets

Related U.S. Application Data filed on Aug. 12, 2019, provisional application No. 62/871,407, filed on Jul. 8, 2019.

(58) Field of Classification Search
USPC ..... 206/148, 150, 151; 294/87.2
See application file for complete search history.

(56) References Cited

U.S. PATENT DOCUMENTS

| | | | | |
|---|---|---|---|---|
| 5,323,895 | A * | 6/1994 | Sutherland | B65D 71/40 206/161 |
| 5,441,147 | A * | 8/1995 | Tanner | B65D 71/504 294/87.2 |
| 5,487,464 | A | 1/1996 | Galbierz et al. | |
| 5,538,133 | A * | 7/1996 | Campbell | B65D 71/42 206/427 |
| 5,573,111 | A * | 11/1996 | Gordon | B65D 71/42 206/151 |
| 5,682,982 | A | 11/1997 | Stonehouse | |
| 11,027,905 | B2 * | 6/2021 | Ford | B65D 71/50 |
| 2015/0191287 | A1 | 7/2015 | L'Heureux et al. | |
| 2018/0362234 | A1 | 12/2018 | L'Heureux et al. | |

FOREIGN PATENT DOCUMENTS

| | | | |
|---|---|---|---|
| DE | 20319247 | U1 | 4/2004 |
| DE | 202018106535 | | 2/2019 |
| EP | 3647226 | A2 | 5/2020 |
| WO | 1993022217 | A1 | 11/1993 |
| WO | 2009023822 | A1 | 2/2009 |

OTHER PUBLICATIONS

Chinese Search Report dated Apr. 19, 2023, issued during the prosecution of Chinese Patent Application No. 2020800628175.
Chilian Office Action issued during the prosecution of Patent Application No. 202200047.
Japanese Office Action dated Nov. 25, 2024, 4 pages, for counterpart application.

* cited by examiner

ARTICLE CARRIER AND BLANK THERFOR

TECHNICAL FIELD

The present invention relates to article top engaging devices, article carriers and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides a package comprising a top-engaging article carrier and one or more articles. The article carrier comprises an engaging panel having an upper panel and a lower panel disposed in face to face contacting relationship with each other. The article carrier comprises a top engaging device comprising a first article receiving opening in the lower panel and a second article receiving opening in the upper panel. The first article receiving opening comprises a first diameter. The second article receiving opening comprises a second diameter. The first diameter is greater than the second diameter. The article comprises an upper end having an end diameter, a main body having a body diameter and a neck disposed therebetween and having a neck diameter. The first diameter is equal to or greater than the end diameter. The end diameter is greater than the neck diameter and the neck diameter is greater than the second diameter.

Optionally, the body diameter is greater than the first diameter. Optionally, the body diameter is greater than the end diameter.

A further aspect of the invention provides an article carrier of the top engaging type for packaging one or more articles. The article carrier comprises an upper panel and a lower panel disposed in face to face contacting relationship with each other. The article carrier comprises a top engaging device comprising a first article receiving opening in the lower panel and a second article receiving opening in the upper panel. The first article receiving opening comprises a first diameter. The second article receiving opening comprises a second diameter. The first diameter is greater than the second diameter. The first article receiving opening consists of a first article receiving aperture. The second article receiving opening comprises a second article receiving aperture.

Optionally, the upper panel is hinged connected to the lower panel by a hinged connection.

Optionally, the upper panel is secured, for example with adhesive, to the lower panel.

Optionally, the lower panel comprises a pair of lower panel portions each hinged connected to the upper panel by a respective hinged connection.

Optionally, one of the pair of lower panel portions overlaps with the other one of the lower panel portions.

Optionally, the second article receiving opening comprises one or more teeth having an engaging edge for engaging with an article.

Optionally, the article carrier comprises a handle structure comprising a handle opening and a tab hingedly connected to one of the upper and lower panels by a hinged connection, the substrate forming the upper and lower panels comprising a grain direction, wherein the hinged connection is oriented perpendicular to the grain direction.

Optionally, the article carrier comprises a handle structure comprising a handle opening and a tab hingedly connected to one of the upper and lower panels by a hinged connection, the substrate forming the upper and lower panels comprising a grain direction, wherein the hinged connection is oriented parallel to the grain direction.

Optionally, the second article receiving opening comprises one or more teeth provided in peripheral region of the upper panel about the second article receiving aperture so as to define a toothed region in a first portion of the perimeter of the second article receiving aperture.

Optionally, the second article receiving opening comprises an engaging edge defining a toothless region about at least a portion of the perimeter of the second article receiving aperture.

Optionally, the article carrier comprises a handle structure including; a recess in a first panel portion, a projection extending from a second panel portion, and a handle opening defined at least in part in the projection, wherein the projection is disposed in overlapping arrangement with the first panel portion such that the handle opening is in vertical alignment with the recess.

Optionally, the handle structure comprises a finger tab hinged to one of the upper or lower panels.

Another aspect of the invention provides a package formed from the article carrier of the foregoing paragraphs and an article, the article comprising an upper end having an end diameter, a main body having a body diameter and a neck disposed therebetween and having a neck diameter, wherein the first diameter is equal to or greater than the end diameter.

Optionally, the body diameter is greater than the first diameter.

Optionally, the neck diameter is greater than the second diameter. Optionally, the body diameter is greater than the end diameter. Optionally, the end diameter is greater than the neck diameter.

Optionally, the second article receiving opening comprises an engaging edge defining a toothless region about at least a portion of the perimeter of the second article receiving aperture and wherein a peripheral region of the upper panel along engaging edge is displaced out of the plane of the upper panel so as to slope upward toward the article.

Yet another aspect of the invention provides a blank for forming an article carrier of the top engaging type. The blank comprises an upper panel and a lower panel arranged to be disposed in face to face contacting relationship with each other. The blank comprises a top engaging device comprising a first article receiving opening in the lower panel and a second article receiving opening in the upper panel. The first article receiving opening comprises a first diameter. The second article receiving opening comprises a second diameter. The first diameter is greater than the second diameter. The first article receiving opening consists of a first article receiving aperture. The second article receiving opening comprises a second article receiving aperture.

Optionally, a cold seal adhesive layer is provided on an inside surface of the upper panel and on an inside surface of the lower panel which inside surfaces are to be disposed in face to face contacting relationship with each other.

Yet a further aspect of the invention provides a blank for forming an article carrier comprising an engaging aperture having at least one engaging edge. The engaging edge is defined between a pair of adjacent notches and the engaging edge is curved. The bottom of each notch is curved. The radius of curvature $R_C$ of each notch is considerably less than the radius of curvature $R_{CT}$ of the engaging edge.

Optionally, the blank comprises an upper layer provided by a first main panel and a lower layer provided by a second main panel, the engaging aperture being provided in the upper layer, the upper layer comprising a plurality of notches defining a notional circle $N_{CR}$ concentric with the engaging aperture and being in tangential contact with each of the plurality of notches.

Optionally, the lower layer comprises an opening having a radius of curvature generally equal to the radius of curvature $R_{CR}$ of the notional circle $N_{CR}$ in tangential contact with each of the plurality of notches.

Optionally, the radius of curvature $R_{CR}$ of the notional circle $N_{CR}$ in tangential contact with each of the plurality of notches is less than radius of curvature $R_{CT}$ of the engaging edge.

Optionally, the radius of curvature of the opening in the lower layer is less than radius of curvature $R_{CT}$ of the engaging edge.

Optionally, the radius of curvature $R_{CR}$ of the notional circle $N_{CR}$ in tangential contact with each of the plurality of notches and the radius of curvature of the opening in the lower layer may be less than radius of curvature $R_{CT}$ of the engaging edge.

Optionally, the engaging edge is defined by a tooth.

Optionally, the engaging edge is by non-tooth engaging element.

Optionally, the engaging edge is a tooth edge.

Optionally, the engaging edge is a toothless engaging edge.

Still yet another aspect of the invention provides a blank for forming an article carrier comprising an engaging aperture having at least two engaging elements, wherein the at least two engaging elements are spaced apart from each other by a notch and the engaging edge of each engaging element is curved, the bottom of each notch is curved, wherein the radius of curvature $R_C$ of each notch is considerably less than the radius of curvature $R_{CT}$ of the engaging edge.

Optionally, the at least two engaging elements comprise at least two teeth.

Optionally, the at least two engaging elements comprise at least two non-tooth engaging elements.

Optionally, the at least two engaging elements comprise at least one teeth and at least one non-tooth engaging element.

Optionally, the radius of curvature $R_{CT}$ of the engaging edge is greater than a half of the diameter of an article engaged in a setup carrier.

Optionally, the radius of curvature $R_C$ of each relief element is about 2.38 mm (3/32").

Optionally, the radius of curvature $R_C$ of each relief element is in the range 1.59 mm (1/16") to 4.76 mm (3/16").

Optionally, the radius of curvature $R_{CT}$ of the engaging edge is about 50 mm (63/32").

Optionally, the radius of curvature $R_{CT}$ of the engaging edge is in the range 30 mm (1.181") to 75 mm (189/64").

Optionally, the ratio of the radius of curvature ($R_C$) of the notches to the radius of curvature $R_{CT}$ of the engaging edge, ($R_C/R_{CT}$), is in the range 0.02 to 0.16, ($0.02<R_C/R_{CT}<0.16$).

Optionally, the corner of each engaging element is rounded and wherein the radius of curvature ($R_{TC}$) of the rounded corner may be generally equal to the radius of curvature $R_C$ of the notch.

Still yet a further aspect of the invention provides a blank for forming an article carrier comprising an engaging aperture having at least one notch along its perimeter, the engaging aperture comprising a notional circle concentric with the engaging aperture and being in tangential contact with the at least one notch, wherein the notional circle has a diameter ($2\times R_{CR}$) which is equal to or greater than the diameter of the upper can chime and less than the diameter of the can body, and wherein the diameter of the engaging aperture is less than the upper can chime such that when the upper can chime is received in the engaging aperture, a region of blank peripheral to the engaging aperture is displaced upwardly with respect to the remainder of the blank to bring the perimeter of the engaging aperture into engagement with the underside of the upper can chime.

Optionally, the notional circle diameter ($2\times R_{CR}$) is generally equal to the diameter of the upper can chime.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
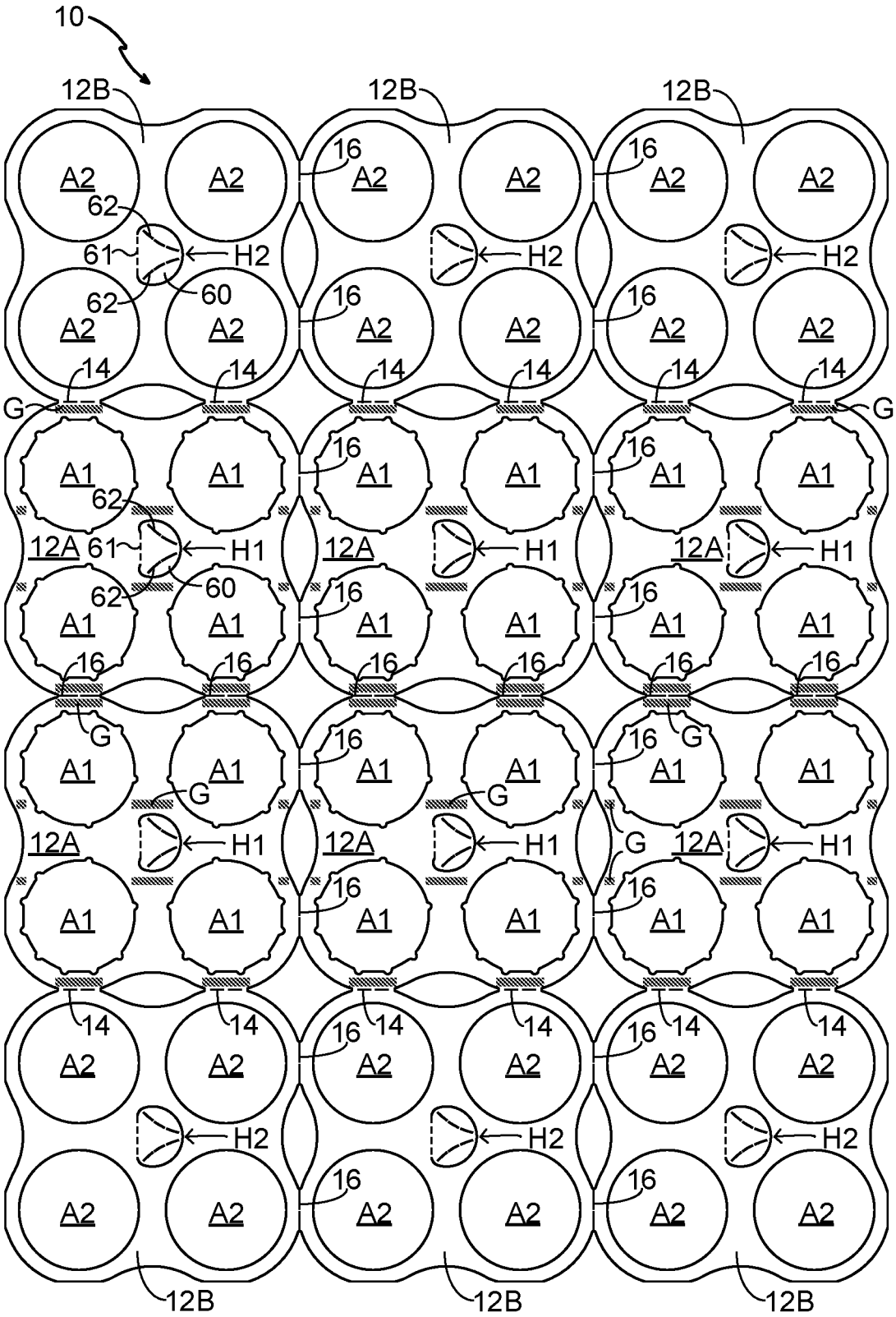
FIG. 1 is a plan view from above of a plurality of connected blanks, each blank capable of forming a carrier according to a first embodiment.
Figure 2:
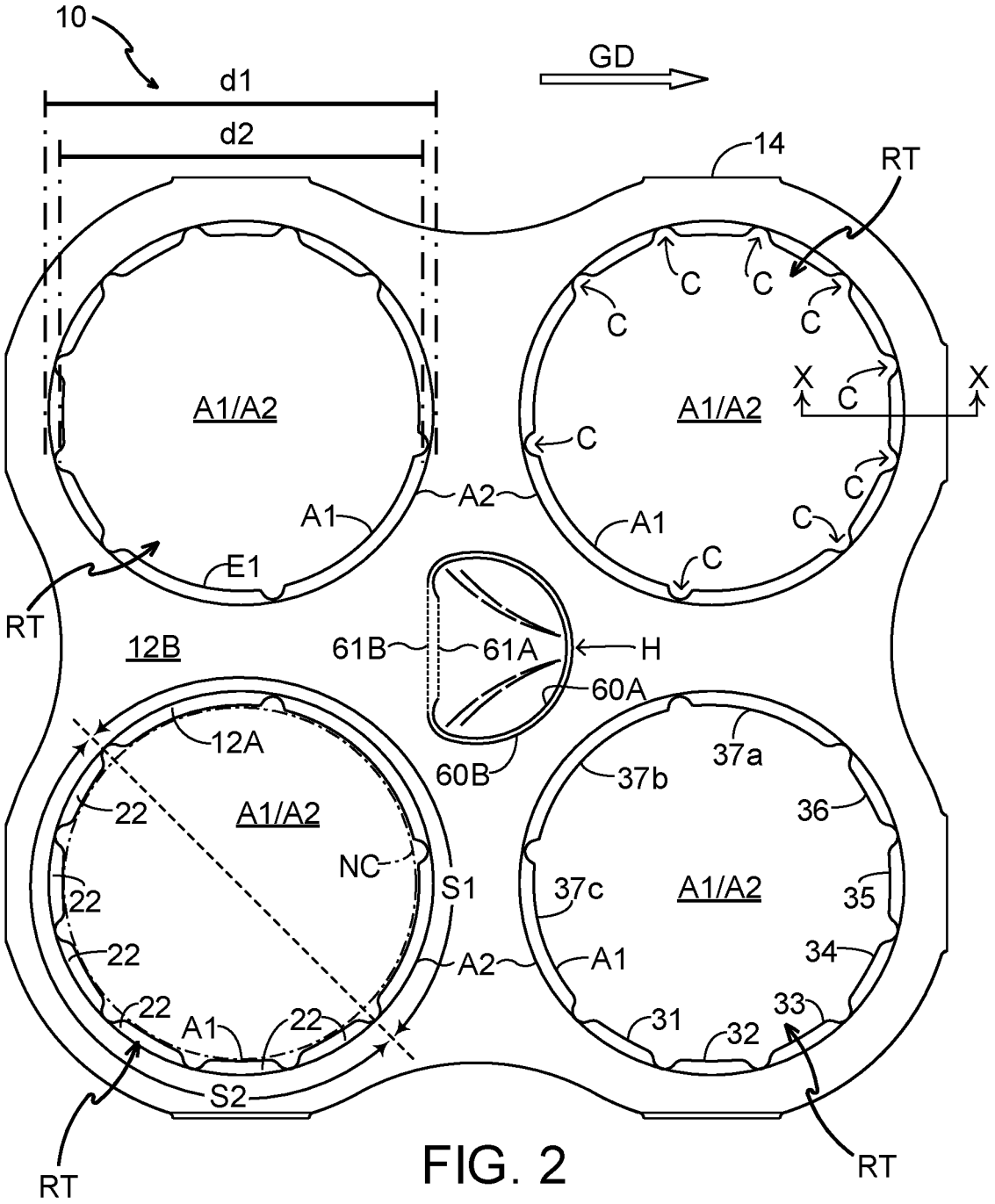
FIG. 2 is a plan view from above of one of the blanks of FIG. 1.
Figure 3:
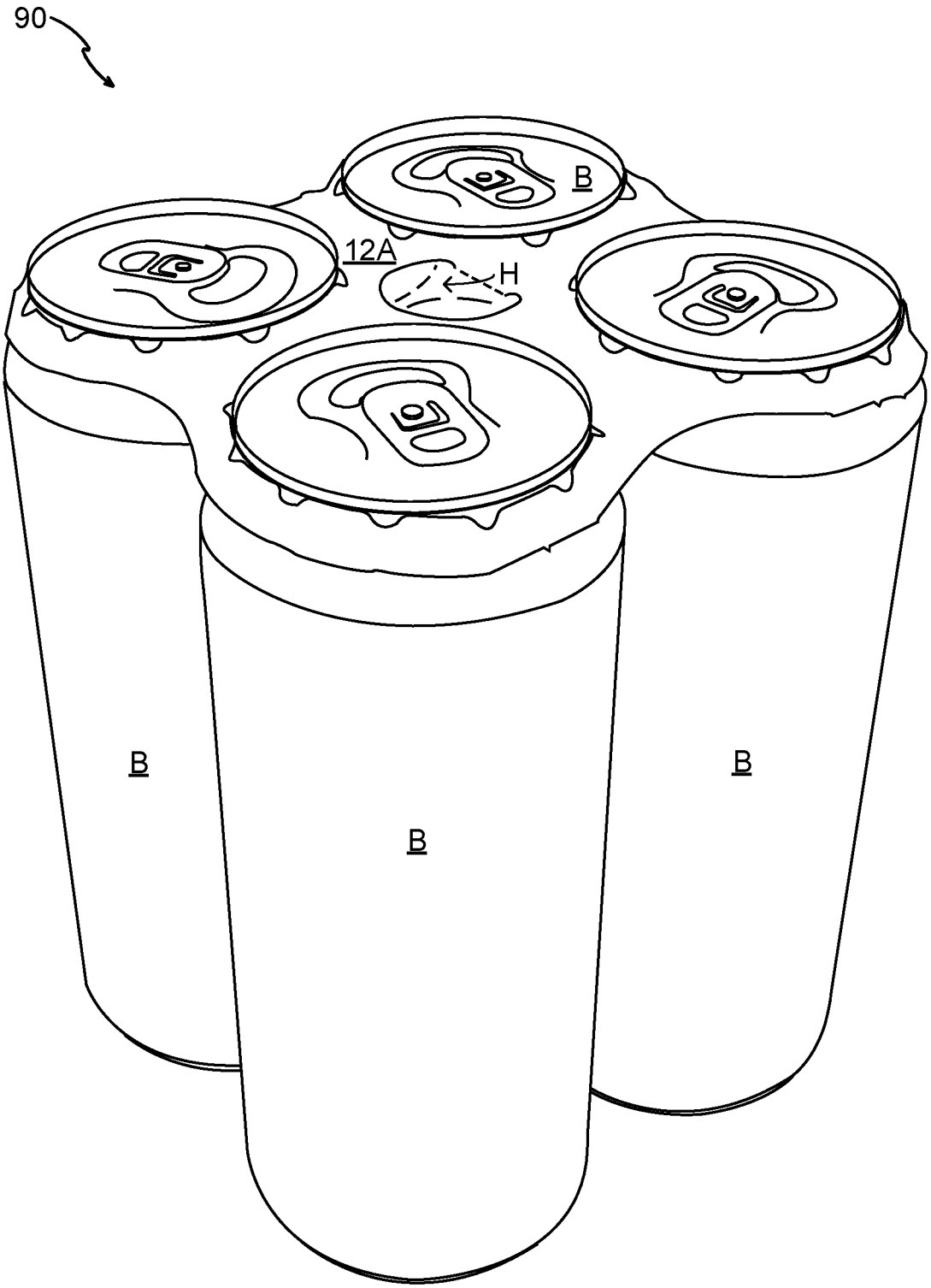
FIG. 3 is a perspective view from above of a carrier formed from the blank of FIG. 2.

Referring to FIG. 1, there is shown a plan view of a plurality of connected blanks 10; an individual blank 10 is shown in FIG. 2 which is capable of forming a carton or carrier 90, as shown in FIG. 3, for containing and carrying a group of primary products such as, but not limited to, bottles or cans, hereinafter referred to as articles B, as shown in FIG. 3. The blank 10 forms a secondary package for packaging at least one primary product container or package. Alternative blanks 110, 210, 310, 410, 510, are shown in FIGS. 4, 5, 6, 7 and 10.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminum cans), tins, pouches, packets and the like.

The blanks 10,110, 210, 310, 410, 510 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10,110, 210, 310, 410, 510 are configured to form a carton or carrier 90 for packaging an exemplary arrangement of exemplary articles B. In the embodiment illustrated in FIGS. 1, 2, 3 and 10 the arrangement is a 2×2 matrix or array; in the illustrated embodiment two rows of two articles are provided, and the articles B are beverage cans. In the embodiments illustrated in FIGS. 4 and 7, the arrangement is a 3×2 matrix or array; in the illustrated embodiments three rows of two articles are provided, and the articles B are beverage cans. In the embodiments illustrated in FIGS. 5 and 6, the arrangement is a 4×2 matrix or array; in the illustrated embodiments four rows of two articles are provided, and the articles B are beverage cans. Alternatively, the blanks 10, 110, 210, 310, 410, 510 can be configured to form a carrier for packaging other types, number and size of articles and/or for packaging articles in a different arrangement or configuration.

Referring to FIG. 1 there is shown a plurality of connected blanks 10, specifically there are six blanks 10 arranged in a 3×2 matrix or array. Each blank 10 comprises a pair of main panels 12A, 12B for forming a top wall or engaging panel of a carrier 90 (see FIG. 3). Each blank 10 is connected to at least two adjacent blanks 10 by frangible connections 16.

The pair of main panels 12A, 12B comprises a first main panel 12A for forming an upper layer or ply of the carrier 90 and a second main panel 12B for forming a lower layer or ply of the carrier 90. Each first main panel 12A is hingedly connected to a respective second main panel 12B by a hinged connection in the form of a fold line 14.

The pair of main panels 12A, 12B includes at least one article retention structure RT, see FIG. 2. In the embodiment of FIGS. 1 and 2 the engaging panel 12A/12B comprises a plurality of article retention structures RT, specifically four article retention structures RT arranged in 2×2 matrix or array. Each of the article retention structures RT comprise an aperture A1.

The article retention structure RT comprises an article receiving opening defined in part by a first aperture A1 defined in or struck from the first main panel 12A.

The article receiving opening is defined in part by a second aperture A2 defined in or struck from the second main panel 12B.

The second aperture A2 is substantially circular in shape and has a first diameter d1. The first aperture A1 comprises, or defines in, the first main panel 12A, an edge E1; the edge E1 defines a notional circle NC having a second diameter d2. The second diameter d2 is smaller than the first diameter d1.

The first aperture A1 comprises one or more cutaways C in the form of recesses or notches. The cutaways C are substantially "U" shaped, in other embodiments the cutaways C may be alternatively shaped such as but not limited to "V" shaped. The cutaways C extend radially outward from the notional circle.

The first aperture A1 and second aperture A2 are arranged to be substantially concentric with each other. That is to say the notional circle NC of the first aperture A1 is concentric with the second aperture A2.

The cutaways C may be arranged to extend radially outward by a distance substantially half the difference between the first diameter d1 and the second diameter d2, ½(d1−d2).

The article retention structure RT may comprise a first segment S1, as shown in FIG. 2, and a second segment S2. The first segment S1 defines a first arc and the second segment S2 defines a second arc.

The first segment S1 may be 'toothed', the second segment S2 may be 'toothless'. That is to say the first aperture A1 comprises a plurality of teeth disposed about the first arc, in a perimeter region of the first aperture A1 defined by the first segment S1. A perimeter region, second arc, of the first aperture A1 defined by the second segment S2 is free from teeth. In the embodiment illustrated in FIG. 2B the second segment S2 defines a continuous arcuate edge.

The 'toothed' region comprises a plurality of teeth 22 formed in the first main panel 12A about the first aperture A1.

Each tooth 22 comprises an engaging or tooth edge 31, 32, 33, 34, 35, 36. Each tooth edge 31, 32, 33, 34, 35, 36 may be linear in shape or may be arcuate. The tooth edges 31, 32, 33, 34, 35, 36 may be defined by an arc or portion of a circle. The first aperture A1 comprises a perimeter which may approximate, or define, the notional circle NC. The tooth edges 31, 32, 33, 34, 35, 36 may be defined by an arc or portion of a circle which approximates a linear edge.

The 'toothed' region of the main panel 12 surrounding the first aperture A1 may comprise cutaways C in the form of recesses or notches.

The teeth 22 are each defined, at least in part, by a pair of cutaways C. The cutaways C form relief elements extending radially away from the center of the notional circle.

The toothless or tooth free region of the first main panel 12A surrounding the first aperture A1 comprises an engaging or free edge 37*a*, 37*b*, 37*c*. The engaging edge 37*a*, 37*b*, 37*c* is curvilinear or arcuate in shape.

The toothless or tooth free region of the first main panel 12A surrounding the first aperture A1 may be defined in, or occupy, an arc subtending an angle, which angle has its vertex at the center of the notional circle. In some embodiments the angle may be substantially 180°, in other embodiment the angle may be less than 180°, for example but not limited to 170°.

In this way substantially half of the perimeter of the first aperture A1 comprises teeth 22.

The article retention structure RT comprises two adjacently disposed relief elements C between which a continuous supporting or engaging edge 37*a*, 37*b*, 37*c* is defined.

The two adjacent relief elements C of the continuous supporting edge 37*a*, 37*b*, 37*c* are tangentially contacted by a notional tangential line. The notional tangential line passes through respective tangential contacting points on the two adjacent relief elements C of the continuous supporting edge 37*a*, 37*b*, 37*c*. The notional tangential line contacts or intersects with the notional circle.

Figure 12:
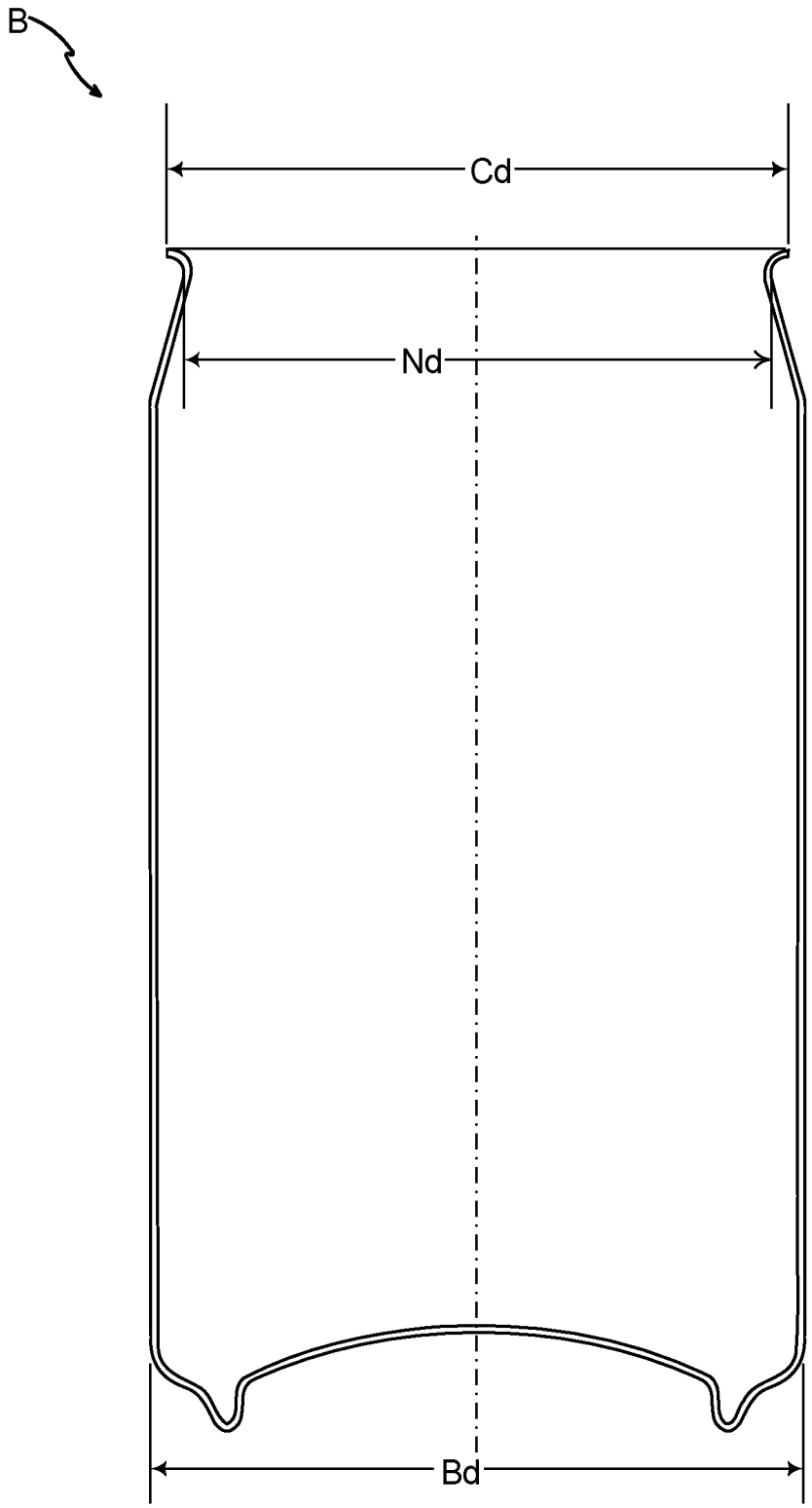
FIG. 12 is a vertical cross section of an exemplary article B in the form of a beverage can.

The article retention structure RT is arranged to accommodate an article B. FIG. 12 illustrates an exemplary article B in the form of a beverage can. The article B comprises an upper end defined by a chime or canners end seam, where a top or closure is affixed to the wall of the can. The upper end comprises a diameter Cd. The article B comprises a neck below the chime, the neck comprises a diameter Nd. The neck diameter Nd is smaller than the chime diameter Cd, (Cd>Nd). The article B comprises a main body having a diameter Bd, the body diameter Bd is larger than the chime diameter Cd and the neck diameter Nd, (Bd>Cd>Nd). In some embodiments the body diameter Bd may be substantially equal to the chime diameter Cd, (Bd≅Cd).

The chime and the neck define an undercut with which the article carrier 90 can engage the article B. The undercut has a radial or lateral dimension equal to half the difference between chime diameter Cd and the neck diameter Nd.

The first diameter d1 (the diameter of the second aperture A2) is greater than or equal to the chime diameter Cd (the diameter of the upper end of the article B), (d1≥Cd).

The second diameter d2 (the diameter of the first aperture A1 or the notional circle NC defined by the first aperture A1) is less than the neck diameter Nd, (Nd>d2).

The first diameter d1 (the diameter of the second aperture A2) is less than the body diameter Bd (the diameter of the main body of the article B), (Bd>d1).

In this way, the following relationship between the diameters of the first and second apertures A1, A2 and the article B exists; (Bd>d1≥Cd>Nd>d2).

The blank 10 may optionally comprise a handle H1/H2. The first main panel 12A may comprise a first handle structure H1. The second main panel 12B may comprise a second handle structure H2. The first handle structure H1 comprises a first handle opening. The first handle opening defined in or is struck from the first main panel 12A and is located in a region disposed centrally between a first pair of first apertures A1 and a second pair of first apertures A1. The first handle opening may be defined at least in part by a first cushioning tab 60A hinged to the first main panel 12A by first fold line 61A.

The second handle structure H2 comprises a second handle opening. The second handle opening defined in or is struck from the second main panel 12B and is located in a region disposed centrally between a first pair of second apertures A2 and a second pair of second apertures A2. The second handle opening may be defined at least in part by a second cushioning tab 60B hinged to the second main panel 12B by second fold line 61B.

The second handle opening is arranged to be in vertical registry with the first handle opening. The second handle opening may be larger than the first handle opening.

The second cushioning tab 60B may be larger than the first cushioning tab 60A. The second cushioning tab 60B is prevented or inhibited from folding upwardly such that the second cushioning tab 60B passes or extends through the first handle opening in the first main panel 12A. This in turn inhibits or restricts access to the first cushioning tab 60A such that upward folding of the first cushioning tab 60A is discouraged or difficult, whereas the first and second cushioning tabs 60A, 60B are readily folded downwards such that the first cushioning tab 60A passes or extend through the second handle opening in the second main panel 12B.

The first cushioning tab 60A may be secured to the second cushioning tab 60B to form a composite cushioning tab 60A/60B. In this way the composite cushioning tab 60A/60B is configured to fold downwardly, the first cushioning tab 60A passing or extending through the second handle opening in the second main panel 12B. The composite cushioning tab 60A/60B is prevented or inhibited from folding upwardly such that the second cushioning tab 60B passes or extends through the first handle opening in the first main panel 12A. Either or both of the first and second cushioning tabs 60A, 60B are optional; however, when at least one cushioning tab is employed, it may entirely fill the associated handle opening (when the carrier is in the blank form) or it may partially fill the handle opening. The shape of the handle opening and/or that of the at least one cushioning tab may vary. Various fold lines and fold line arrangements may be used on the at least one cushioning tab.

The second fold line 61B may be offset from the first fold line 61A.

The hinged connections (in the form of fold lines) 61A, 61B of the handle structure H1/H2 are arranged to be substantially perpendicular to the direction of the grain (or machine direction) of the material (e.g., paperboard, cardboard, or etc.) of the blank 10 which grain direction is indicated in FIG. 2 by the arrow GD. The grain direction GD is substantially parallel with the fold line 14.

Optionally, the side edges of the main panel 12 may be arranged in a curvilinear or undulating shape. In this way, a first blank 10 may be arranged in a nested arrangement with a second blank 10. The undulating shape provides that the first and second blanks 10 together define a width which is less than twice the maximum width of an individual blank 10. This may have economic and environmental benefit by reducing the amount of substrate required to produce a given number of blanks 10.

The main panel 12 includes at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 28 point (pt.) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The main panel 12 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The first and second main panels 12A, 12B are configured to form an engaging panel 12A/12B having two layers or plies of paperboard substrate. A first or upper layer of the engaging panel 12A/12B is provided by the first main panel 12A and second or lower layer of the engaging panel 12A/12B is provided by the second main panel 12B. The second main panel 12B may be bonded or glue to the first main panel 12A.

Suitable glue locations G are shown in FIG. 1. In other embodiments different locations may be selected or only some of the glue locations shown in FIG. 1 may be employed.

In some embodiments, a cold seal adhesive or self-seal adhesive layer is coated, formed or provided upon the inside surface of the blank 10. The inside surface of the blank 10 comprises the inside surface of the first main panel 12A and the inside surface of the second main panel 12B. The inside surface of the first main panel 12A is brought into face to face contacting relationship with the inside surface of the second main panel 12B to form an engaging panel 12A/12B. Cold seal adhesives seal or bond only to themselves. As such, when the inside surface of the first main panel 12A coated with the cold seal adhesive comes into contact with that of the second main panel 12B coated with the same cold seal adhesive, bond results by simply applying some pressure. (Cold seal adhesive differ from a heat seal adhesive that requires adhesive only on one substrate but must have a source of heat and pressure to make the bond. Cold seal adhesives are different from pressure-sensitive adhesives, which are permanently tacky and must have a release paper covering to prevent adhering to anything until the final use.) The cold seal adhesives useful with the article carrier of the invention typically comprise natural rubber latex. Other components may added to the rubber latex, such as synthetic polymers (e.g., an antioxidant).

Figure 11:
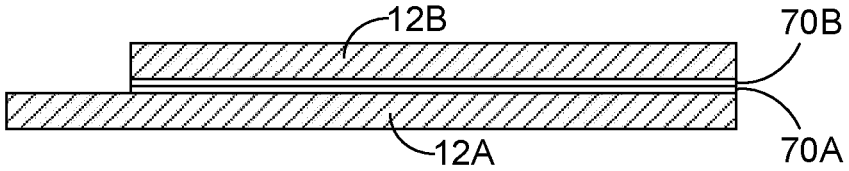
FIG. 11 is a cross section taken along the line X-X in FIG. 2.

FIG. 11 shows a cold seal adhesive layer 70A on the upper panel or first main panel 12A, which have been be brought into contact with a cold seal adhesive layer 70B on the lower panel or second main panel 12B. Those cold seal adhesive layers 70A, 70B may be brought into contact each other in the process, for example, of carrier application to articles B such that they are activated to secure the upper and lower panels 12A, 12B together.

In one example only the glue locations proximate the frangible connections 16 may be employed.

The first and second main panels 12A, 12B may be formed from a paperboard substrate having coating on one side. The uncoated side of the first main panel 12A may be bonded to the uncoated side of the second main panel 12B with an adhesive treatment or glue. In one example the first and second main panels 12A, 12B are formed from 28 pt CBS or CNK board, in alternative embodiments different thicknesses or calipers or paperboard may be employed. This produces an engaging panel 12A/12B having a thickness of about 0.056", around 1.4 mm, having coating on opposing faces thereof. An advantage of such a substrate is increased strength without the inclusion of a polymeric material or plastics material, such substrates may provide environmental benefit and be more easily recycled.

The second main panels 12B are folded, about fold lines 14, with respect to the first main panel 12A to which they are hinged. Each second main panel 12B is brought into face to face relationship with the first main panel 12A to which it is hinged. Each second main panel 12B may be secured to the first main panel 12A to which it is hinged.

The plurality of blanks 10 of FIG. 1 may thus be formed into a plurality of connected engaging panels 12A/12B each having two plies. Each of the plurality of connected engaging panels 12A/12B is frangibly connected to at least two other engaging panels 12A/12B.

In some embodiments at least one tear resistant layer may be disposed between the first and second layers of the substrate, such a substrate may be formed by bonding two sheets of material at least one of which comprises a tear resistant layer laminated thereto. This may have the advantage of increasing the strength of the substrate.

Turning to the construction of the carrier 90 from the blank 10, the blank 10 may be applied to a group of articles B. The blank 10 is lowered with respect to the group of articles B. Each of the article retention structures RT of the blank 10 are aligned with a respective article B in the group. Portions of the articles B pass through the engaging panel 12A/12B. The toothed regions of the first main panel 12A about each of the article retention structures RT may be folded out of the plane of the first main panel 12A.

Each toothed region of the main panel 12 may be folded about one of the articles received in the respective one of the article retention structures RT. The blank 10 may deform about the article B for example but not limited to a shoulder portion of the article, where the article B is a can the shoulder portion may be provide by the neck-in.

The engaging edges 31, 32, 33, 34, 35, 36 of the teeth 22 and the engaging edge 37*a*, 37*b*, 37*c* of the tooth free region of the first main panel 12A engage beneath a projection of the article B. The projection may be located about the neck or chime of the article B (which may provide a flange) of an article B. When the article B is a can the projection may be provided by a canner's end seam. In other embodiments it may be provided by a ridge or undercut shaping of the article B or by an end closure of the article B for example but not limited to a crown cork or closure. In this way, the engaging edges 31, 32, 33, 34, 35, 36, 37 grip or hold the article B and prevent or inhibit the article B from unintentionally separating from the engaging panel 12A/12B. The assembled carrier 90 is shown in FIG. 3.

In some embodiments, the toothless region along the engaging edge 37*a*, 37*b*, 37*c* of the first main panel 12A proximate the first aperture A1 folds or deforms out of the plane of the first main panel 12A upon application of the engaging panel 12A/12B onto an article B. The toothless region of the first main panel 12A along the engaging edge 37*a*, 37*b*, 37*c* slopes upwards toward the respective article B.

Another optional feature of the carrier 90 is that the main panel 12 is defined by a perimeter to which no other part of the carrier 90 is connected. That is to say, the carrier 90 is free of connection to other panels for example, but not limited to, side or end wall panels which extend about the sides of the article group. The perimeter of the main panel 12A/12B is therefore defined in its entirety by free, cut or unhinged edges.

Another optional feature of the carrier 90 is that the main panel 12A/12B is defined by a perimeter including convexly curved edges and concavely curved edges, wherein the radius of curvature of the convexly curved edges is substantially equal to the radius of curvature of the concavely curved edges, thus allowing two similar blanks 10 to be placed in a nested or tessellated arrangement.

In some embodiments the plurality of blanks 10 or plurality of connected engaging panels 12A/12B is applied simultaneously to a first group of articles B. The first group of articles B is divisible into a plurality of second groups of articles B. Each second group of articles B is thus formed from a subset of the first group of articles B. In the embodiment illustrated in FIG. 1 the first group of articles B comprises twenty-four articles arranged in a 4×6 matrix or array, and each individual blank 10 accommodates four articles in a 2×2 matrix or array. In this way the plurality of connected engaging panels 12A/12B forms six article carriers 90 or packages.

The frangible connections 14 between the first main panels 12A may separate upon application of the plurality of connected engaging panels 12A/12B to the first group of articles B. Alternatively, the frangible connections 14 may remain intact, individual carriers 90 may be separated from the others at a point of sale or distribution.

Referring now to FIGS. 4 to 10, there is shown additional embodiments of the present disclosure. In the second, third, fourth, fifth, sixth, seventh and eighth illustrated embodiments like numerals have, where possible, been used to denote like parts, albeit with the addition of the prefix "100", "200", "300", "400", "500" to indicate that these features belong to the second, third, fourth, fifth and sixth embodiments respectively. The additional embodiments share many common features with the first embodiment and therefore only the differences from the embodiment illustrated in FIGS. 1 to 3 will be described in detail.

Figure 4:
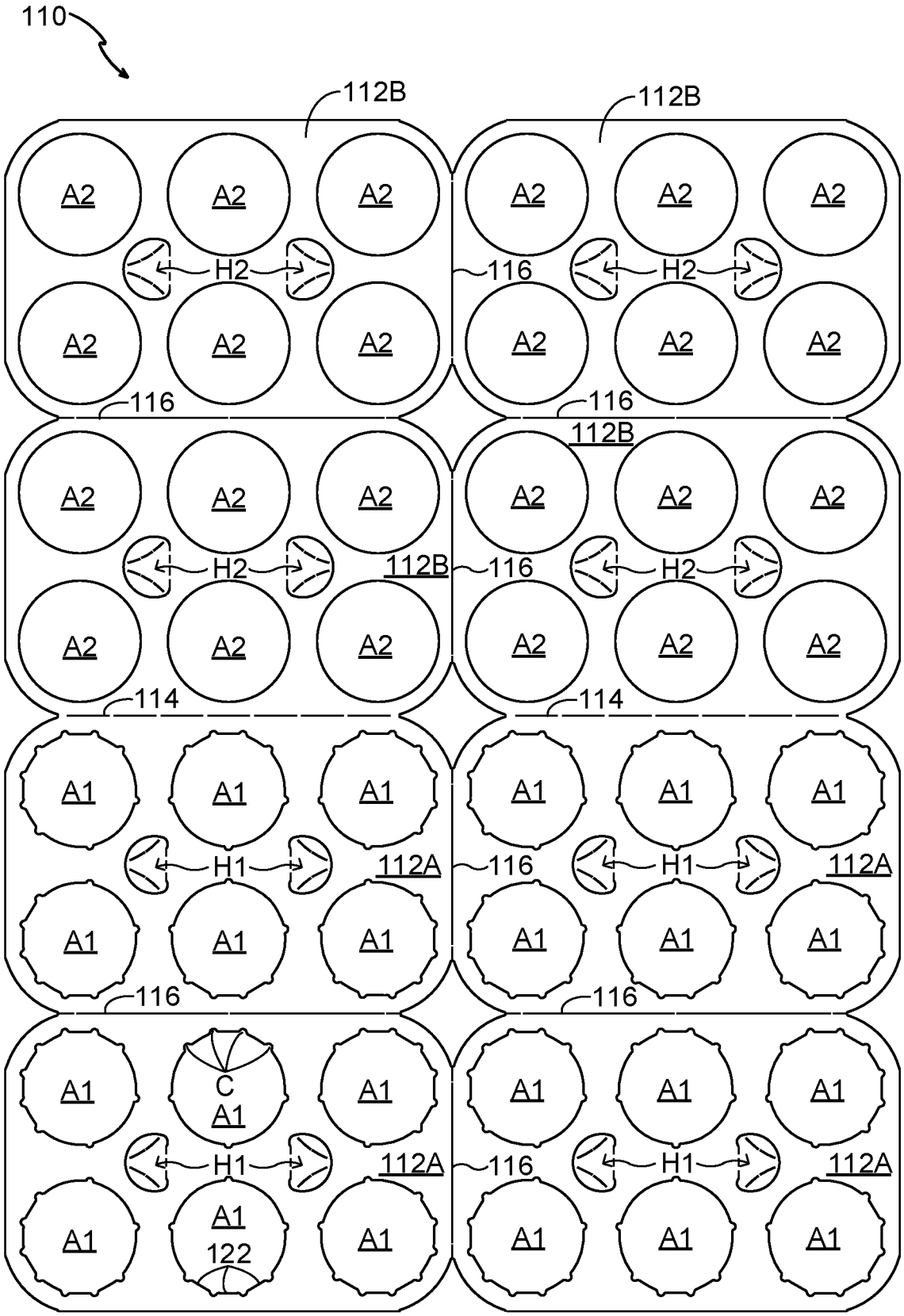
FIG. 4 is a plan view from above of a plurality of connected blanks, each blank capable of forming a carrier according to a second embodiment.

FIG. 4 illustrates a second embodiment and shows a plurality of connected blanks 110 specifically there are four blanks 110, arranged in a matrix or array. Each blank 110 comprises a pair of main panels 112A, 112B for forming a top wall or engaging panel 112A/112B of a carrier (not shown). The plurality of connected blanks 110 comprises four first main panels 112A arranged in a 2×2 matrix or array to form a group of first main panels 112A and four second main panels 112B arranged in a 2×2 matrix or array to form a group of second main panels 112B. Each first main panel 112A is connected to at least two adjacent first main panels 112A by frangible connections 116. Each second main panel 112B is connected to at least two adjacent second main panels 112B by frangible connections 116. The group of second main panels 112B is hingedly connected to the group of first main panels 112A by hinged connections in the form of a fold line 114. The group of first main panels 112A is arranged to be folded about the fold line 114 to be disposed in face to face relationship with the group of first main panels 112A such that each one of the first main panels 112A is disposed in vertical registry with a respective one of the second main panels 112B. In this way a plurality of connected engaging panels 112A/112B or article carriers is formed, the plurality of connected article carriers having a 2×2 matrix or array arrangement. Each of the plurality of connected article carriers is frangibly connected to at least one adjacent article carrier.

The pair of main panels 112A, 112B includes at least one article retention structure. The pair of main panels 112A, 112B comprises a plurality of article retention structures, specifically six article retention structures arranged in 3×2 matrix or array.

The first main panel 112A of each blank 110 includes four article receiving openings in the form of first apertures A1 configured and arranged substantially as described above in relation to the first apertures A1 of the embodiment of FIG. 1. The article receiving openings are located proximate corners of the first main panel 112A and are referred to as endmost or corner article receiving openings.

The first main panel 112A of each blank 110 includes two additional article receiving openings located centrally or medially of the first main panel 112A and are referred to as inner or intermediate article receiving openings.

Each intermediate article receiving opening is disposed between a pair of endmost article receiving openings.

The intermediate article receiving openings comprise three teeth 122, each tooth 122 is defined in part by a pair of relief elements C. Each tooth 122 comprises an engaging edge. The engaging edges of the teeth occupy a portion of the perimeter of the aperture A1, the portion defines an arc of a notional circle having a center, the angle subtended by the arc may be less than 120°, it may be greater than 60° and may be around 90°. The intermediate article receiving openings comprises a toothless or tooth free portion. The tooth free region comprises an engaging edge which is defined between a pair of relief elements C. The engaging edge of the tooth free region may comprise one or more cutaways or relief elements, the illustrated embodiment comprises three cutaways.

The second main panel 112B of each blank 110 includes six article receiving openings in the form of second apertures A2 configured and arranged substantially as described above in relation to the second apertures A2 of the embodiment of FIG. 1.

Each of the second apertures A2 is substantially circular in shape and has a first diameter. Each of the first apertures A1 comprises a free edge the free edge defines a notional circle having a second diameter. The second diameter is smaller than the first diameter.

The first and second main panels 112A, 1128 may optionally comprise a handle structure H1, H2. The handle structure H1, H2 may comprise a pair of first openings struck from or defined in the first main panel 112A. The handle structure H1, H2 may comprise a pair of second openings struck from, or defined in, the second main panel 112B.

Each of the first openings may be defined in part by a first cushioning tab hinged to the first main panel 112A by a fold line. Each of the second openings may be defined in part by a second cushioning tab hinged to the second main panel 112B by a fold line.

One of the pair of first openings is located in a region disposed centrally between a first pair of article receiving openings and a second pair of article receiving openings provided in the first main panel 112A. The other one of the pair of first openings is located in a region disposed centrally between the second pair of article receiving openings and a third pair of article retention receiving openings provided in the first main panel 112A. The pair of first openings may be arranged in opposition to each other, such that the cushioning tabs are hinged to the first main panel 112A in opposition to each other.

One of the pair of second openings is located in a region disposed centrally between a first pair of article receiving openings and a second pair of article receiving openings provided in the second main panel 112B. The other one of the pair of second openings is located in a region disposed centrally between the second pair of article receiving openings and a third pair of article retention receiving openings provided in the second main panel 112B. The pair of second openings may be arranged in opposition to each other, such that the cushioning tabs are hinged to the second main panel 112B in opposition to each other.

Figure 5:
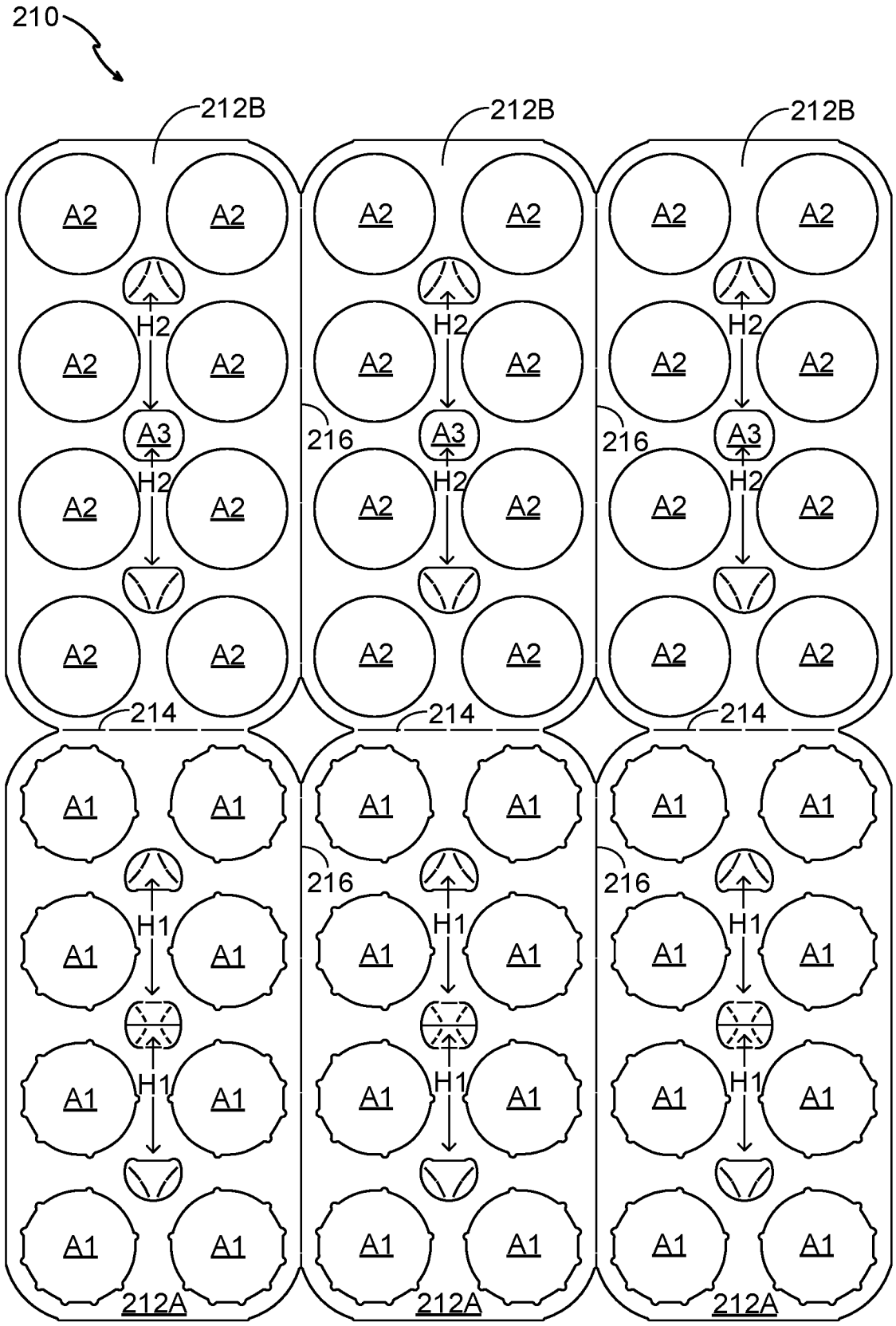
FIG. 5 is a plan view from above of a plurality of connected blanks, each blank capable of forming a carrier according to a third embodiment.

FIG. 5 illustrates a third embodiment and shows a plurality of connected blanks 210 specifically there are three blanks 210, arranged in a 1×3 matrix or array. Each blank 210 comprises a pair of main panels 212A, 212B for forming a top wall or engaging panel of a carrier (not shown). Each blank 210 is connected to at least one adjacent blank 210, by a frangible connection 216.

Each of the pair of main panels 212A, 212B includes a first main panel 212A hingedly connected to a second main panel 212B by a hinged connection in the fold of a fold line 214.

The pair of main panels 212A, 212B includes at least one article retention structure. The pair of main panels 212A, 212B comprises a plurality of article retention structures, specifically eight article retention structures arranged in 4×2 matrix or array.

The first main panel 212A of each blank 210 includes four article receiving openings in the form of first apertures A1 configured and arranged substantially as described above in relation to the first apertures A1 of the embodiment of FIG. 1. The article receiving openings are located proximate corners of the first main panel 212A and are referred to as endmost or corner article receiving openings. The first main panel 212A of each blank 210 includes four additional article receiving openings located between the endmost article receiving openings, these intermediate article receiving openings are configured and arranged substantially as described above in relation to the intermediate article receiving openings of the embodiment of FIG. 4.

The first and second main panels 212A, 212B may optionally comprise a handle structure H1, H2. The handle structure H1, H2 may comprise a pair of first openings struck from or defined in the first main panel 212A.

Each of the first openings may be defined in part by a first cushioning tab hinged to the first main panel 212A by a fold line.

One of the pair of first openings is located in a region disposed centrally between a first pair of endmost article receiving openings and an adjacent first pair of intermediate article receiving openings provided in the first main panel 212A. The other one of the pair of first openings is located in a region disposed centrally between the second pair of endmost article receiving openings and an adjacent second pair of intermediate article receiving openings provided in the first main panel 212A. The pair of first openings may be arranged in opposition to each other, such that the cushioning tabs are hinged to the first main panel 212A in opposition to each other.

The handle structure H1, H2 may comprise a third opening struck from or defined in the first main panel 212A. The third opening is located in a region disposed centrally between the first pair of intermediate article receiving openings and the second pair of intermediate article receiving openings. The third opening may be defined by a pair of finger tabs hinged to the first main panel 212A in opposition to each other.

The handle structure H1, H2 may comprise a pair of second openings struck from, or defined in, the second main panel 212B.

Each of the second openings may be defined in part by a second cushioning tab hinged to the second main panel 212B by a fold line.

One of the pair of second openings is located in a region disposed centrally between a first pair of endmost article receiving openings and an adjacent first pair of intermediate article receiving openings provided in the second main panel 212B. The other one of the pair of second openings is located in a region disposed centrally between the second pair of endmost article receiving openings and an adjacent second pair of intermediate article receiving openings provided in the second main panel 212B. The pair of second openings may be arranged in opposition to each other, such that the cushioning tabs are hinged to the second main panel 212B in opposition to each other.

The handle structure H1, H2 may comprise a fourth opening struck from, or defined in, the second main panel 212B. The fourth opening is located in a region disposed centrally between the first pair of intermediate article receiving openings and the second pair of intermediate article receiving openings. The fourth opening may be defined by a finger aperture A3. The fourth opening may be arranged to be in vertical registry with the third opening. The fourth opening may be arranged to be larger in size than the third opening.

Figure 6:
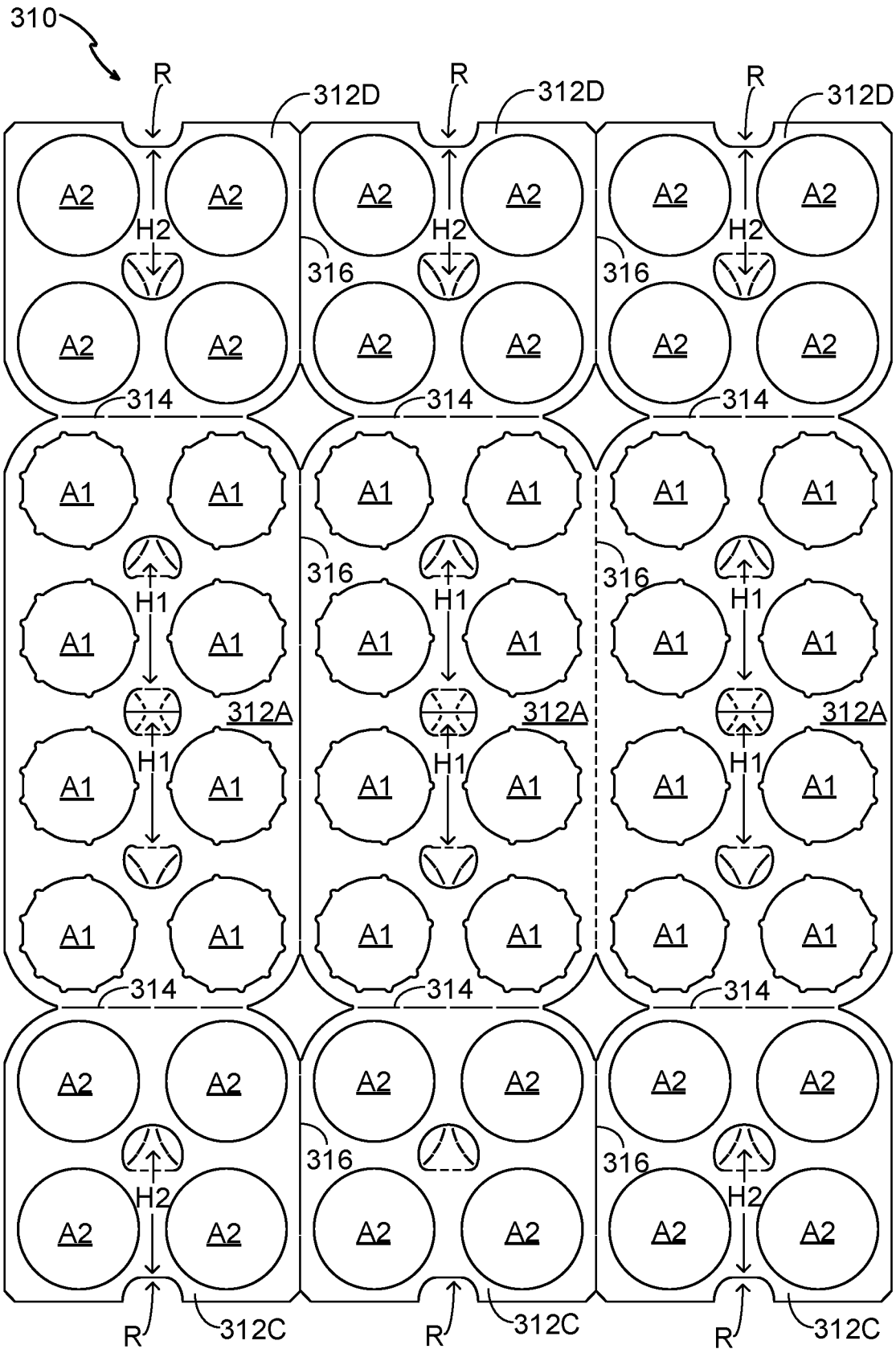
FIG. 6 is a plan view from above of a plurality of connected blanks, each blank capable of forming a carrier according to a fourth embodiment.

FIG. 6 illustrates a fourth embodiment and shows a plurality of connected blanks 310; specifically there are three blanks 310, arranged in a 1×3 matrix or array. Each blank 310 comprises a first main panel 312A for forming a part of top wall or engaging panel of a carrier (not shown). Each blank 310 comprises a pair of second panel portions 312C, 312D. Together the pair of second panel portions 312C, 312D form a second main panel disposed in face to face relationship with the first main panel 312A.

Each of the pair of second panel portions 312C, 312D is hingedly connected to the first main panel 312A by a hinged connection in the form of a fold line 314.

Second panel portions 312C, 312D are hinged to opposing ends of the first main panel 312A.

Each of the second panel portions 312C, 312D comprises a cutaway in the form of a recess R struck from a free end edge thereof. The free end edge opposes the hinged connection to the first main panel 314.

When the pair of second panel portions 312C, 312D are folded into face to face relationship with the first main panel 314 the recesses R of the second panel portions 312C, 312D together define a fourth opening in the second main panel. The fourth opening is disposed in registry with a third opening in the first main panel forming part of a handle structure H1, H2.

Figure 7:
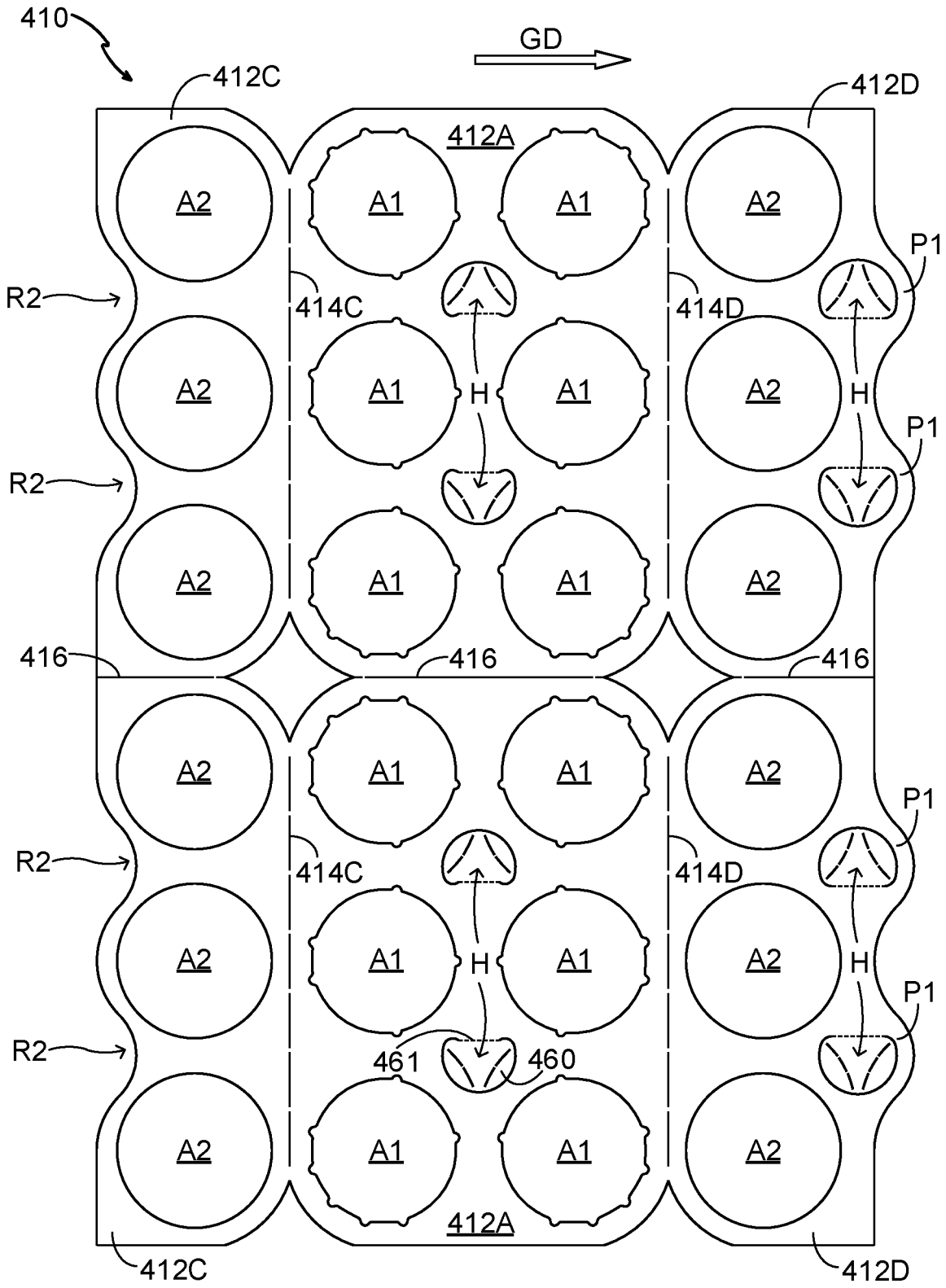
FIG. 7 is a plan view from above of a plurality of connected blanks, each blank capable of forming a carrier according to a fifth embodiment.

FIG. 7 illustrates a fifth embodiment and shows a blank 410 for forming an article carrier. The carrier takes the form of a top-gripping clip or carrier. FIG. 7 illustrates a pair of blanks 410 arranged in 1×2 matrix or array. A first blank is frangibly connected to a second blank by frangible connections 416.

Each blank 410 comprises an upper main panel 412A for forming a part of top wall or engaging panel of a carrier (not shown). Each blank 310 comprises a pair of lower panel portions 412C, 412D. Together the pair of lower panel portions 412C, 412D form a lower main panel disposed in face to face relationship with the upper main panel 412A. Lower panel portions 412C, 412D are hinged to opposing sides of the upper main panel 412A by hinged connections in the form of fold lines 414C, 414D respectively.

The blank 410 includes at least one article retention structure. The blank 410 comprises a plurality of article retention structures, specifically six article retention structures arranged in 3×2 matrix or array.

The upper main panel 412A of each blank 410 includes six article receiving openings in the form of first apertures A1 configured and arranged substantially as described above in relation to the first apertures A1 of the embodiment of FIG. 1, albeit with four teeth rather than the six teeth illustrated and described in relation to FIG. 1. The article receiving openings are located proximate corners of the upper main panel 412A and are referred to as endmost or corner article receiving openings. The upper main panel 412A of each blank 410 includes two additional article receiving openings located between the endmost article receiving openings, these intermediate article receiving openings are configured and arranged substantially as described above in relation to the intermediate article receiving openings of the embodiment of FIG. 4 albeit with one tooth (defined by a pair of relief element or cutaways) rather than the three teeth illustrated and described in relation to FIG. 4.

Each of the pair of lower panel portions 412C, 412D comprises three article receiving openings in the form of second aperture A2, arranged to be disposed in registry with a respective one of first apertures A1 in the upper main panel 412A.

A first lower panel portion 412C comprises a pair of recesses R2 defined in, or struck from, a free edge of thereof, the free edge opposes the hinged connection to the upper main panel 412A. The recesses R2 are configured and arranged to avoid obstruction of handle openings provided in the first main panel 412A when folded into face to face relationship therewith, best shown in FIG. 8A.

A second lower panel portion 412D comprises a pair of projections P1 extending from a free edge of thereof, the free edge opposes the hinged connection to the upper main panel 412A. The projections are arranged to accommodate handle openings H. The handle opening may be defined by cushioning flaps hinged to second lower panel portion 412D.

Figure 8B:
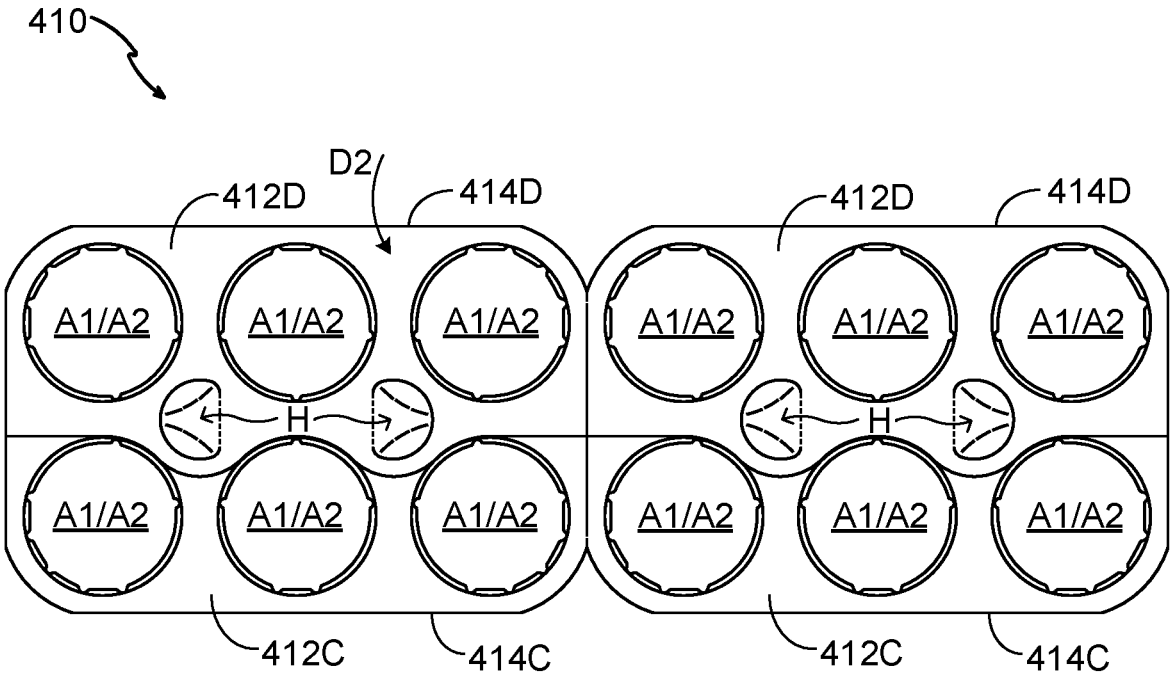
FIGS. 8A and 8B illustrate stages of construction of a carrier formed from the blank of FIG. 7.
Figure 8A:
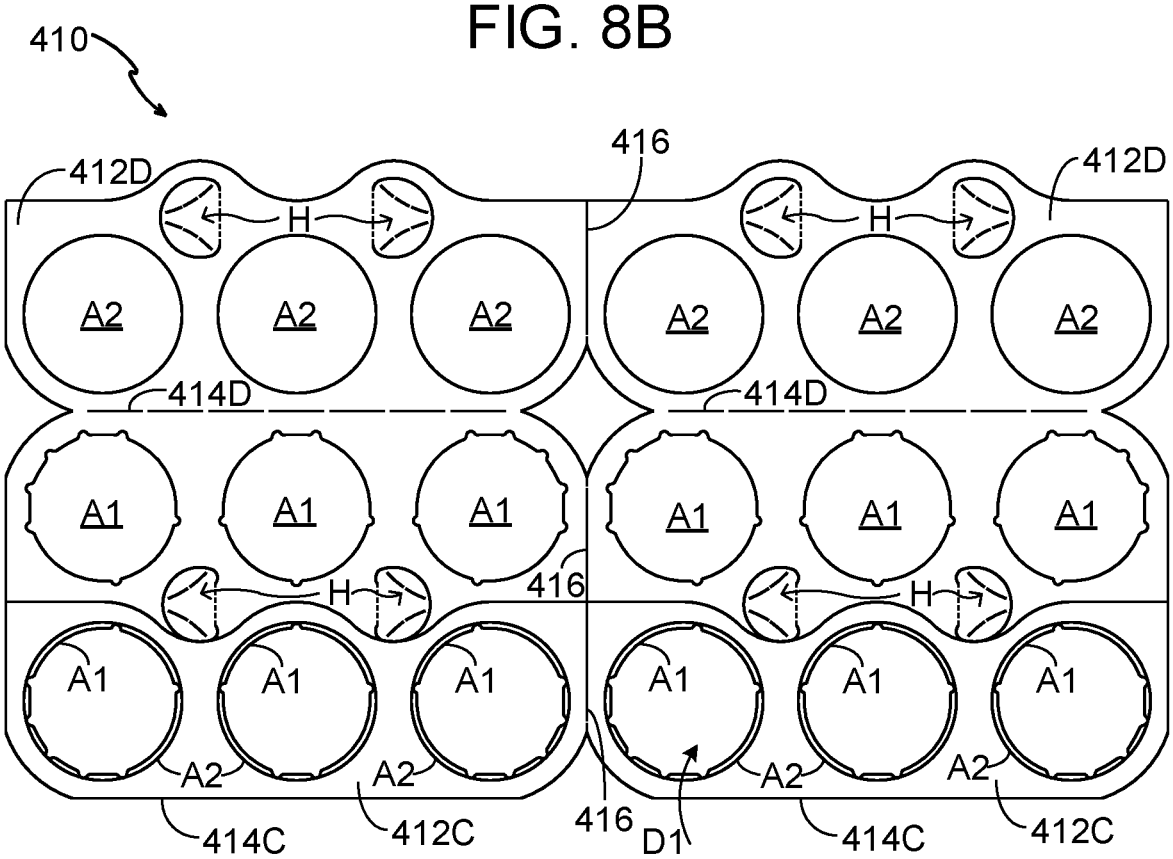

The hinged connections (in the form of fold lines) 461 of the handle structure H are arranged to be substantially parallel to the direction of the grain of the material (e.g., paperboard, cardboard, etc.) of the blank which grain direction is indicated in FIG. 7 by the arrow GD. The grain direction GD is substantially perpendicular with the fold lines 414C, 414D The second lower panel portion 412D may be arranged to be disposed in partial overlapping relationship with first lower panel portion 412C, as shown in FIG. 8B. The second lower panel portion 412D may be secured to the first lower panel portion 412C with glue or other adhesive treatment.

The projection P1 is disposed in overlapping arrangement with the first lower panel portion 412C such that the handle opening in the second lower panel portion 412D is in vertical alignment with the recess R2.

In some embodiments, the first lower panel portion 412C and second lower panel portion 412D are secured to first main panel 412A with glue or other adhesive treatment.

In other embodiments the second lower panel portion 412D is secured to first main panel 412A with glue or other adhesive treatment. The first lower panel portion 412C is disposed between the second lower panel portion 412D and first main panel 412A so as to be held in place.

Figure 9:
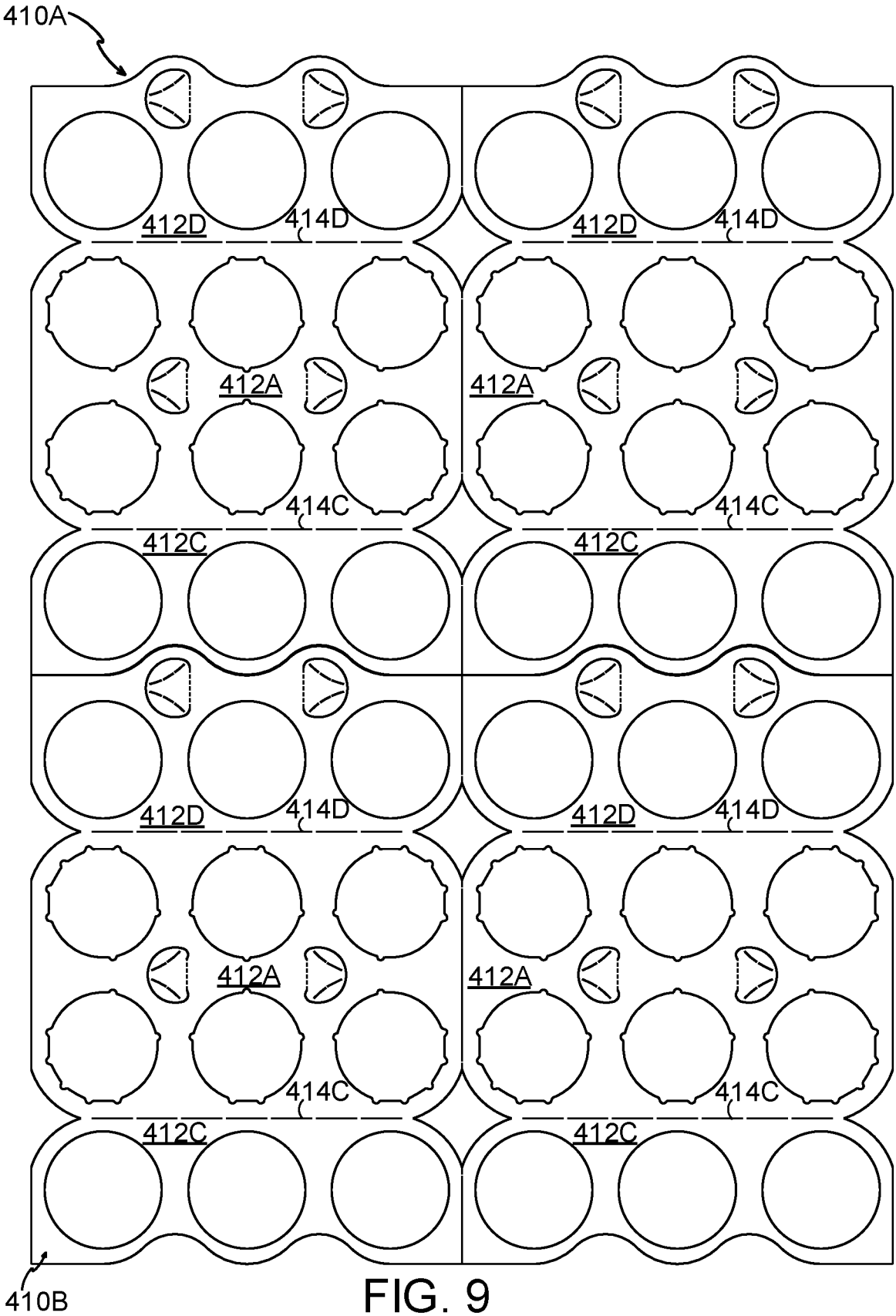
FIG. 9 is a plan view from above of a plurality of connected blanks of FIG. 7 in a nested configuration.

FIG. 9 illustrates a first plurality of blanks 410 arranged in a nested arrangement with a second plurality of blanks 410 and separated by a cut line.

Figure 10:
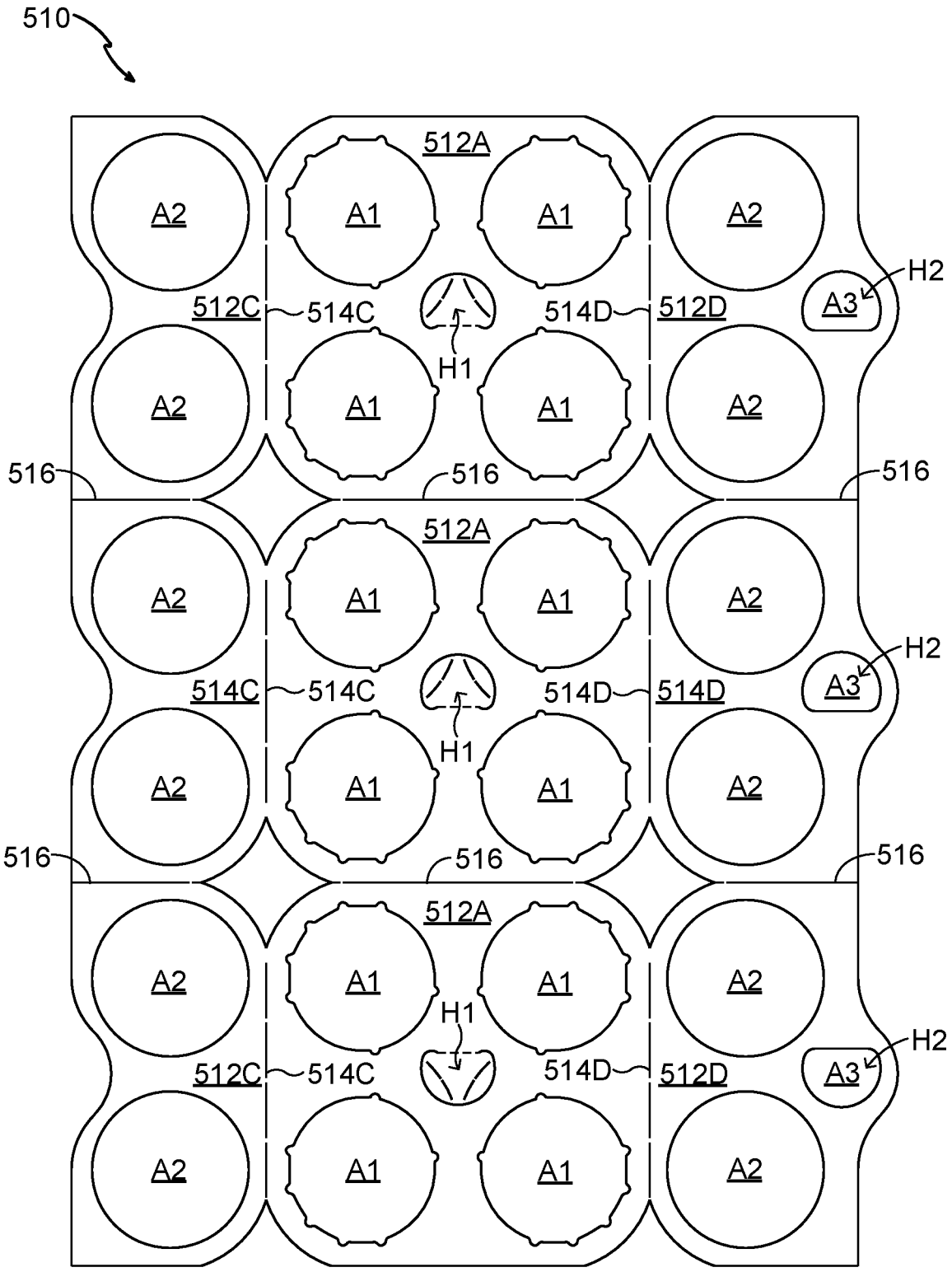
FIG. 10 is a plan view from above of a plurality of connected blanks, each blank capable of forming a carrier according to a sixth embodiment.

FIG. 10 illustrates a sixth embodiment and shows a plurality of blanks 510 for forming article carriers (not shown). The article carrier takes the form of a top-gripping clip or carrier. Each of the blanks 510 is substantially similar in construction to the blank 410 of FIG. 7 and comprises a main panel 512 forming a top panel of the carrier. In the sixth embodiment the blanks 510 are arranged to accommodate four articles arranged in a 2×2 matrix or array. An upper main panel 512A comprises four article receiving openings. First and second lower panel portions 512C, 512D each comprises a pair of article receiving openings. The first lower panel portion 512C comprises one recess R2. The second lower panel portion 512D comprises one projection P1 comprising a handle opening defined by a finger aperture A3.

Referring now to FIGS. 13, 14A to 14D and 15, there is shown a further embodiment of the present disclosure. In the seventh illustrated embodiment like numerals have, where possible, been used to denote like parts, albeit with the addition of the prefix "900 to indicate that these features belong to the seventh embodiment. The additional embodiments share many common features with the first embodiment and therefore only the differences from the embodiment illustrated in FIGS. 1 to 2 will be described in detail.

Figure 13:
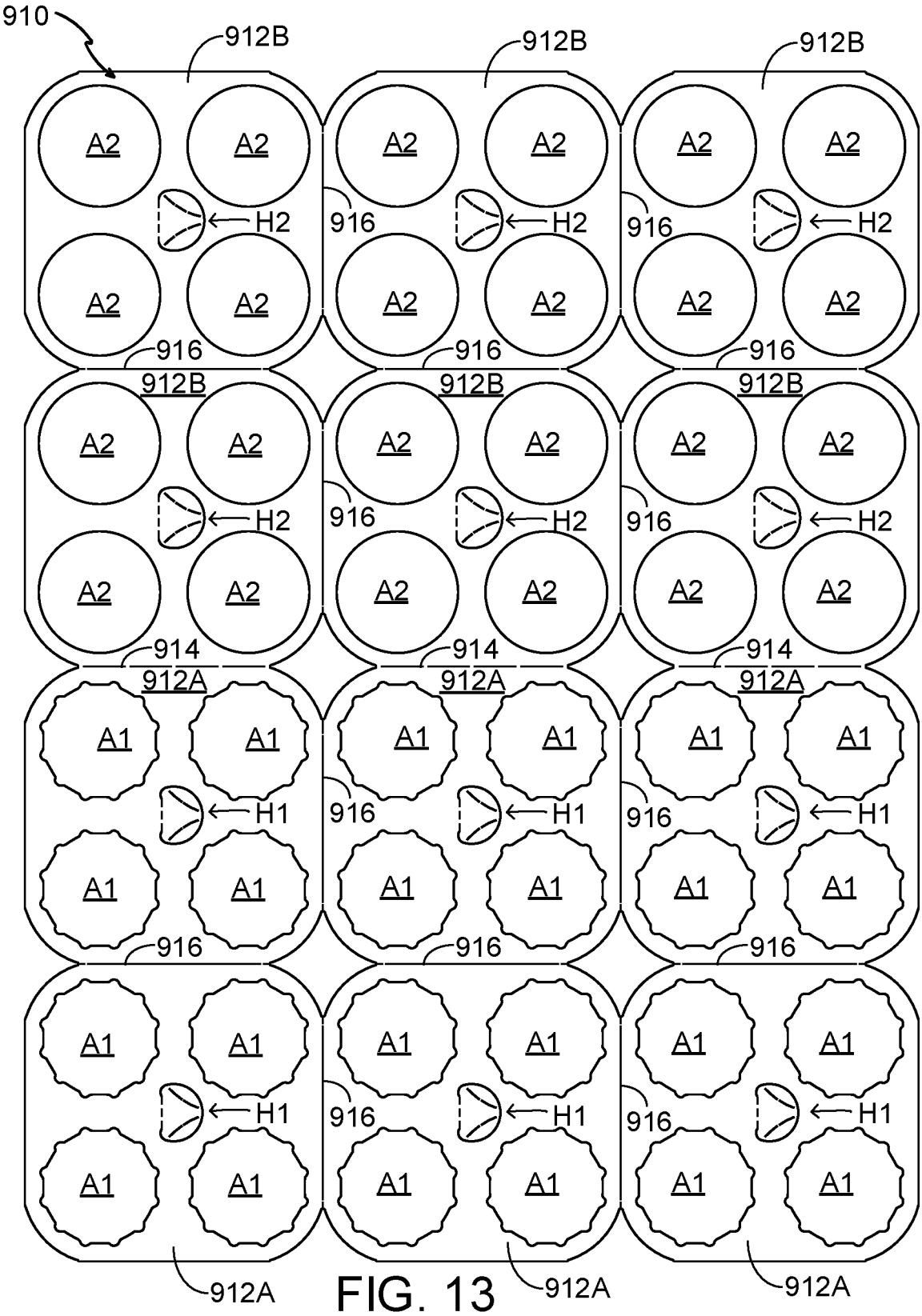
FIG. 13 is a plan view from above of a plurality of connected blanks, each blank capable of forming a carrier according to a seventh embodiment.

FIG. 13 illustrates a plurality of connected blanks 910 specifically there are six blanks 910, arranged in a matrix or array. Each blank 910 comprises a pair of main panels 912A, 912B for forming a top wall or engaging panel 912A/912B of a carrier 990 (see FIG. 15). The plurality of connected blanks 910 comprises six first or upper main panels 912A arranged in a 3×2 matrix or array to form a group of first main panels 912A and six second or lower main panels 912B arranged in a 3×2 matrix or array to form a group of second main panels 912B. Each first main panel 312A is connected to at least two adjacent first main panels 912A by frangible connections 916. Each second main panel 912B is connected to at least two adjacent second main panels 912B by frangible connections 916. The group of second main panels 912B is hingedly connected to the group of first main panels 912A by hinged connections in the form of a fold line 914. The group of first main panels 912A is arranged to be folded about the fold line 914 to be disposed in face to face relationship with the group of first main panels 912A such that each one of the first main panels 912A is disposed in vertical registry with a respective one of the second main panels 912B. In this way a plurality of connected engaging panels 912A/912B or article carriers is formed, the plurality of connected article carriers having a 3×2 matrix or array arrangement. Each of the plurality of connected article carriers is frangibly connected to at least one adjacent article carrier.

Each pair of main panels 912A, 912B includes at least one article retention structure. Each pair of main panels 912A, 912B comprises a plurality of article retention structures, specifically four article retention structures arranged in 2×2 matrix or array.

The first main panel 912A of each blank 910 includes four article receiving openings in the form of first apertures A1.

The second main panel 912B of each blank 910 includes four article receiving openings in the form of second apertures A2.

Each of the first apertures A1 comprises a perimeter which may approximate, or define, a notional circle $N_{CE}$. The notional circle $N_{CE}$ comprises a radius $R_{CE}$, best shown in FIG. 14D Each article retention structure comprises a plurality of teeth 922, see FIGS. 14B, 14C and 14D disposed about the circumference or perimeter of apertures A1.

The teeth 922 are formed in the first main panel 912A about the apertures A1.

Each tooth 922 comprises an engaging or tooth edge 931. Each tooth edge 931 is arcuate. The tooth edges 931 are defined by an arc or portion of a circle $N_{CT}$. In some embodiments the tooth edges 931 may defined by an arc or portion of a circle $N_{CTMIN}$, the radius $R_{CTMIN}$ of the circle $N_{CTMIN}$ being less than the radius $R_{CT}$ of the circle $N_{CT}$. In other embodiments the tooth edges 931 may defined by an arc or portion of a circle $N_{CTMAX}$, the radius $R_{CTMAX}$ of the circle $N_{CTMAX}$ being greater than the radius $R_{CT}$ of the circle $N_{CT}$. In one example the circle $N_{CT}$ may have a radius of 50 mm (63/32"). The radius of the circle may be in the range 30 mm (1.181") to 75 mm (189/64").

In the illustrated embodiment the tooth edges 931 are defined by a portion of the circle $N_{CT}$, the circle $N_{CT}$ comprises a radius $R_{CT}$ which is greater than the radius $R_{CE}$ of the notional circle $N_{CE}$ of the apertures A1.

The first main panel 912A comprises cutaways C in the form of recesses or notches. The cutaways C are substantially "U" shaped, the cutaways C each define a portion of a notional circle N see FIG. 14C. The notional circle N comprises a radius $R_C$.

The cutaways C extend radially outward from the notional circle $N_{CE}$ defined by the teeth 922.

The teeth 922 are each defined, at least in part, by a pair of cutaways C. The cutaways C form relief elements extending radially away from the center of the notional circle $N_{CE}$.

Figure 14A:
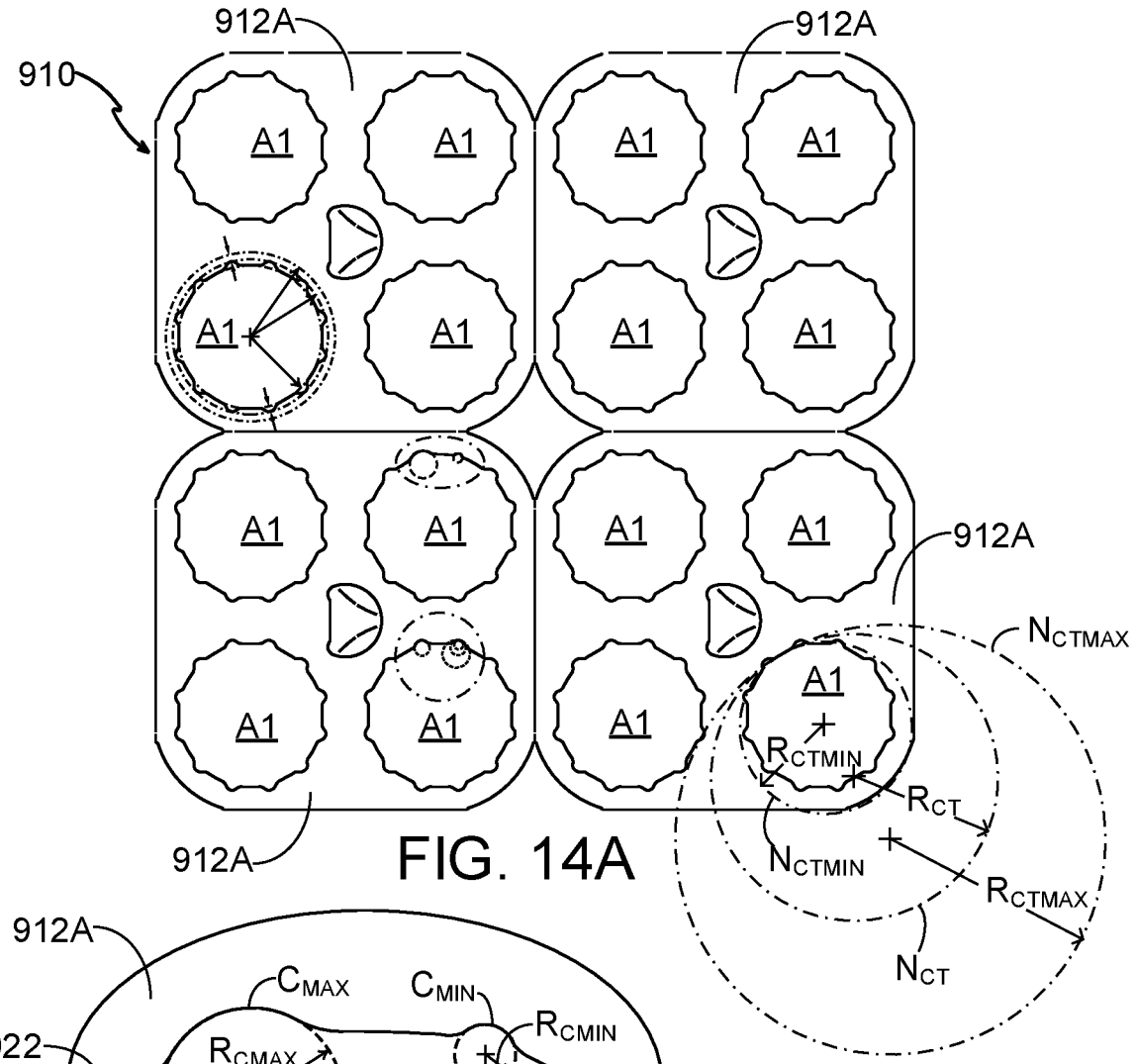
FIG. 14A is a plan view from above of a portion of the plurality of connected blanks, of FIG. 13.
Figure 14B:
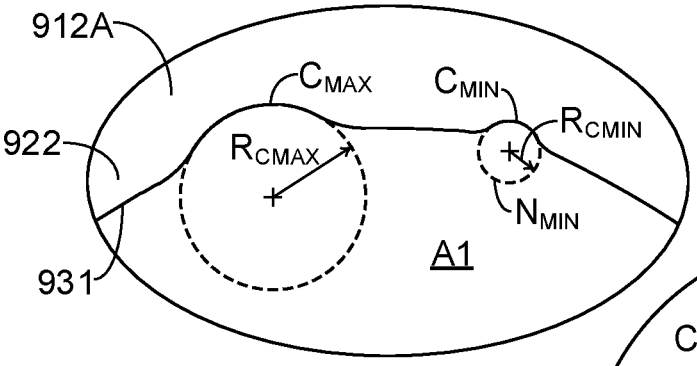
FIG. 14B is an enlarged plan view of a portion of one of the blanks of FIG. 14A showing an article retention structure.

In some embodiments the main panel 912 comprises cutaways $C_{MAX}$ each defining a portion of a notional circle $N_{MAX}$ see FIG. 14B. The notional circle $N_{MAX}$ comprises a radius $R_{CMAX}$. The radius $R_{CMAX}$ is greater than the radius $R_C$.

Figure 14C:
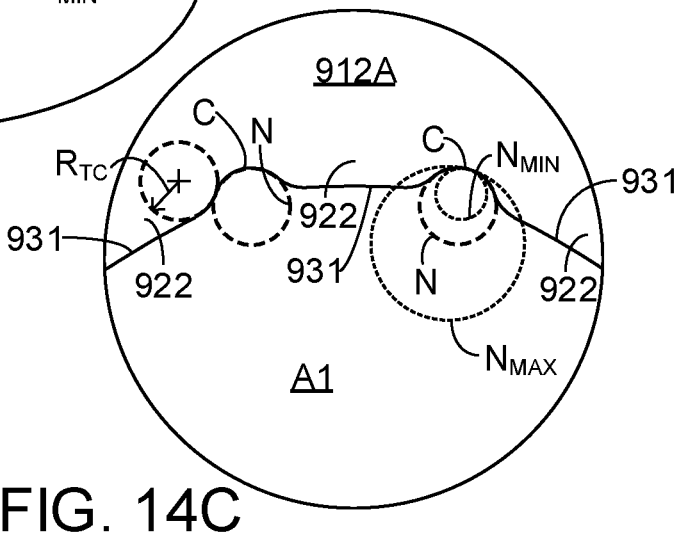
FIG. 14C is an enlarged plan view of another portion of one of the blanks of FIG. 14A showing optional article retention structure arrangements.

In some embodiments the main panel 912 comprises cutaways $C_{MIN}$ each defining a portion of a notional circle $N_{MIN}$ see FIG. 14B. The notional circle $N_{MIN}$ comprises a radius $R_{CMIN}$. The radius $R_{CMIN}$ is less than the radius $R_C$. FIG. 14C shows a comparison of the notional circles $N_{MIN}$, N, $N_{MAX}$.

In one embodiment the cutaways C are defined by a radius $R_C$=2.38 mm (3/32"), the radius $R_C$ may be in the range 1.59 mm (1/16") to 4.76 mm (3/16"), that is to say $R_{CMIN}$=1.59 mm (1/16") and $R_{CMAX}$=4.76 mm (3/16").

It will be appreciated that the radius of curvature $R_{CT}$ of the engaging edges of the teeth 922 is substantially greater than the radius of curvature $R_C$ of the cutaways C. The ratio of the radius of curvature $R_C$ of the cutaways C to the radius of curvature $R_{CT}$ of the engaging edges of the teeth 922, ($R_C/R_{CT}$), may be in the range 0.02 to 0.16, ($0.02<R_C/R_{CT}<0.16$).

The outermost portions of the cutaways C define a notional circle $N_{CR}$, the notional circle $N_{CR}$ is concentric with notional circle $N_{CE}$ defined by the apertures A1. The notional circle $N_{CR}$ is comprises a radius $R_{CR}$ which is greater than the radius $R_{CE}$ of the notional circle $N_{CE}$ defined by the apertures A1. A gap, space or distance F1 is defined radially therebetween.

Optionally, the notional circle $N_{CR}$ defined by the cutaways C is arranged to be substantially equal to, or slightly greater than a circle defined by a rim, chime or uppermost end of the article B to be received therein.

Figure 14D:
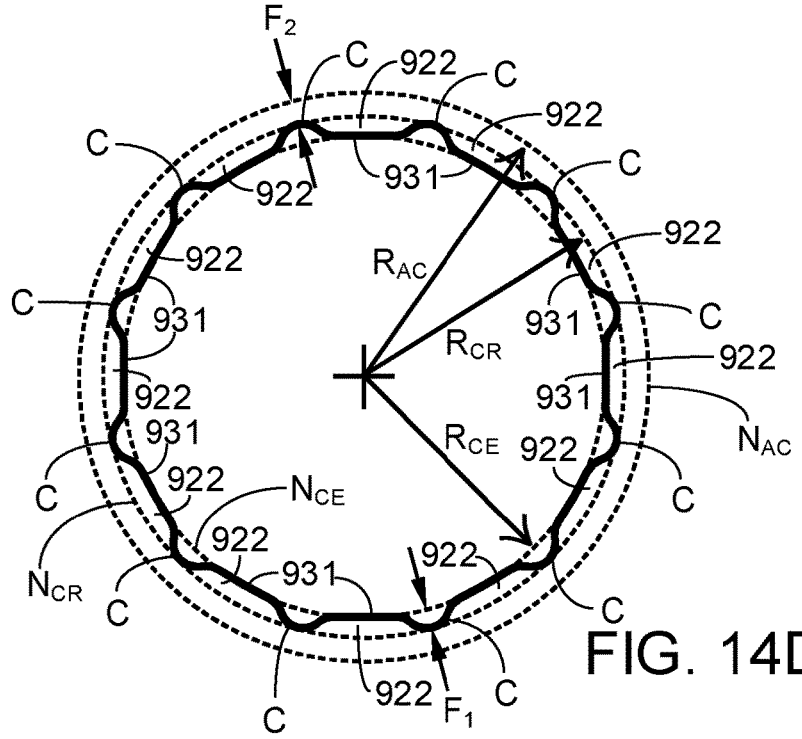
FIG. 14D is an enlarged plan view of an article receiving aperture of the blanks of FIG. 14A.
Figure 15:
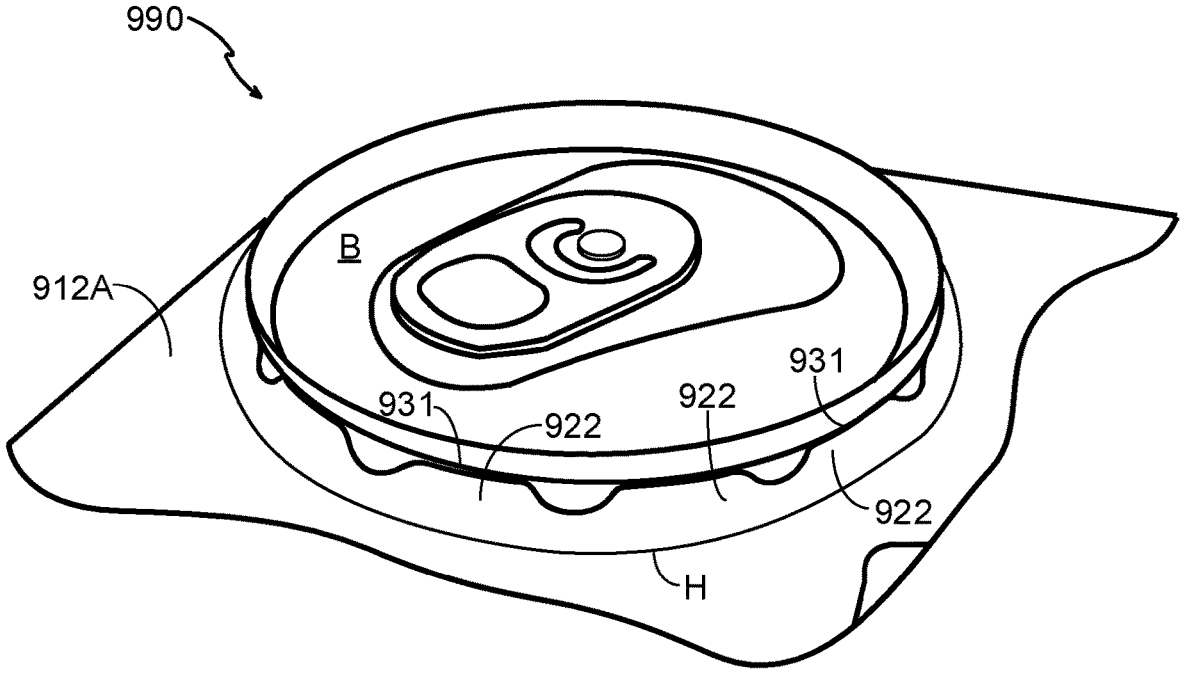
FIG. 15 is a perspective view from above of a portion of a carrier formed from one of the blanks of FIG. 13 illustrating deformation of the carrier about an article.

FIG. 14D shows a notional circle $N_{AC}$, also referred to herein as application circle, it has been found that the main panel 912 deforms proximate to the application circle $N_{AC}$ (see FIG. 15) when an article B is engaged by the main panel 912, a crease line H may be formed in the main panel 912 outside or below the outermost, lowermost, edges of the cutaways C. The application circle $N_{AC}$ is greater in radius than the notional circle $N_{CR}$ defined by the cutaways C by a radial distance F2.

The apertures A1 and cutaways C may be arranged such that the notional circle $N_{CR}$ defined by the cutaways C is substantially equal in radius (diameter) to the radius of second apertures A2 provided in the second main panel 912B. The notional circle $N_{CR}$ defined by the cutaways C and the second apertures A2 arranged to be disposed in registry with each other when the first and second main panels 912A, 912B are in face to face contacting relationship.

The radius of the second apertures A2 provided in the second main panel 912B may be less than the radius $R_{CT}$ of the circle $N_{CT}$ defined by the tooth edges 931.

The radius $R_{CR}$ of the notional circle $N_{CR}$ defined by the cutaways C may be less than the radius $R_{CT}$ of the circle $N_{CT}$ defined by the tooth edges 931.

The present disclosure provides a carrier of the top engaging type having improved article retention structures or article top engaging devices.

The carrier may be provided by a blank comprising an engaging aperture having at least one engaging edge. The engaging edge may be defined by a tooth or by non-tooth engaging element. The engaging edge may be a tooth edge or a toothless engaging edge. The engaging edge is defined between a pair of adjacent relief elements or notches. The engaging edge is curved. The bottom or outer edge of each relief element, recess or notch is curved. The radius of curvature $R_C$ of each relief element or notch is considerably less than the radius of curvature $R_{CT}$ of the engaging edge.

The carrier, or blank, may comprise an upper layer provided by a first main panel and a lower layer provided by a second main panel. The engaging aperture being provided in the upper layer. The upper layer comprising a plurality of notches defining a notional circle $N_{CR}$ concentric with the engaging aperture and being in tangential contact with each of the plurality of notches.

The lower layer may comprise an opening having a radius of curvature generally equal to the radius of curvature $R_{CR}$ of the notional circle $N_{CR}$ in tangential contact with each of the plurality of notches.

The radius of curvature $R_{CR}$ of the notional circle $N_{CR}$ in tangential contact with each of the plurality of notches and/or the radius of curvature of the opening in the lower layer may be less than radius of curvature $R_{CT}$ of the engaging edge.

The carrier may be provided by a blank comprising an engaging aperture having at least two engaging elements. The engaging elements comprise teeth or non-tooth engaging elements or combination thereof. The at least two engaging elements are spaced apart from each other by a relief element, recess or notch. The engaging edge of each engaging element is curved. The bottom or outer edge of each relief element, recess or notch is curved. The radius of curvature $R_C$ of each relief element, recess or notch is considerably less than the radius of curvature $R_{CT}$ of the engaging edge.

The radius of curvature $R_{CT}$ of the engaging edge may be greater than a half of the upper can chime diameter.

The radius of curvature $R_C$ of each relief element may be about 2.38 mm (3/32") for a US standard can having an end or lid diameter of about 54 mm (34/16").

The radius of curvature $R_{CT}$ of the engaging edge may be about 50 mm (63/32") for a US standard can having an end or lid diameter of about 54 mm (34/16").

In some embodiments, the corner of each tooth or non-tooth element may be rounded. The radius of curvature $R_{TC}$ of the rounded corner may be generally equal to the radius of curvature $R_C$ of the relief element.

The carrier may be provided by a blank comprising an engaging aperture having at least one notch along its perimeter. The engaging aperture comprises a notional circle concentric with the engaging aperture and being in tangential contact with the at least one notch. The notional circle has a diameter ($2\times R_{CR}$) which is equal to or greater than the diameter of the upper can chime and less than the diameter of the can body. The diameter of the engaging aperture is less than the upper can chime such that when the upper can chime is received in the engaging aperture, a region of blank peripheral to the engaging aperture is displaced upwardly with respect to the remainder of the blank to bring the perimeter of the engaging aperture into engagement with the underside of the upper can chime.

The notional circle diameter ($2\times R_{CR}$) may be generally equal to the diameter of the upper can chime.

The top engaging article carrier comprises an upper panel and a lower panel disposed in face to face contacting relationship with each other. The top engaging article carrier comprises a top engaging device comprising a first article receiving opening in the lower panel and a second article receiving opening in the upper panel. The first article receiving opening comprises a first diameter. The second article receiving opening comprises a second diameter. The first diameter is greater than the second diameter. The first article receiving opening may consist of a first article receiving aperture. The second article receiving opening may comprise a second article receiving aperture. The second article receiving opening may comprise one or more teeth comprising an engaging edge for engaging with an article.

The top engaging article carrier forms a package with an article, the article comprising an upper end having an end diameter, a main body having a body diameter and a neck disposed therebetween and having a neck diameter. The first diameter is equal to or greater than the end diameter. The body diameter may be greater than the first diameter. The neck diameter may be greater than the second diameter.

The body diameter is greater than the end diameter. The end diameter is greater than the neck diameter.

The top engaging article carrier may accommodate the upper end of article within the top engaging device without folding or deformation of a region of the lower panel. That is to say the upper end of the article can freely pass through the lower panel or be received in the first article receiving aperture. The first article receiving aperture is greater than or equal to the diameter of the article measured at the point of engagement with the lower panel.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted outline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A blank for forming an article carrier, the blank comprising:

a first main panel, having a first area, for forming an upper layer of the article carrier;

a second main panel, having a second area, for forming a lower layer of the article carrier;

wherein the first main panel comprises a plurality of notches and an engaging aperture comprising an engaging edge defined between a pair of the notches, wherein the plurality of notches define a notional circle in tangential contact with an endpoint of each of the plurality of notches, wherein the notional circle concentric with a circle corresponding to the engaging aperture;

wherein the first main panel and the second main panel are arranged to be disposed in face to face contacting relationship with each other when formed as the article carrier;

wherein an article receiving opening is formed in the second main panel for forming the lower layer, wherein the article receiving opening of the second main panel comprises a first diameter, wherein the circle corresponding to the engaging aperture of the first main panel comprises a second diameter, wherein the first diameter is greater than the second diameter, wherein the second area of the second main panel is greater than or equal to one-half of the first area of the first main panel.

2. A blank according to claim 1 wherein the article receiving opening of the second main panel has a radius of curvature generally equal to the radius of curvature of the notional circle.

3. A blank according to claim 1 wherein the engaging edge is defined by at least one of: (i) a tooth, and (ii) a non-tooth engaging element.

4. A blank according to claim 1 wherein the engaging edge is at least one of: a tooth edge and a toothless engaging edge.

5. A blank according to claim 1, wherein the engaging aperture has at least one notch along its perimeter, the engaging aperture comprising a notional circle in tangential contact with the at least one notch, wherein the notional circle is concentric with the engaging aperture, wherein the notional circle has a diameter which is equal to or greater than the diameter of an upper portion of an article to be held by the article carrier and less than the diameter of a body portion of the article, and wherein the diameter of the engaging aperture is less than the diameter of the upper portion of the article such that when the upper portion of the article is received in the engaging aperture, a region of the blank that is peripheral to the engaging aperture is displaced upwardly with respect to the remainder of the blank to bring the perimeter of the engaging aperture into engagement with the upper portion of the article.

6. A blank according to claim 5 wherein the notional circle diameter is generally equal to the diameter of the upper portion of the article.

7. A blank according to claim 1, wherein the first main panel comprises at least two engaging portions disposed around the engaging aperture, each of the engaging portions comprising one of the at least one engaging edge and configured to deform out of a plane shared with the first main panel upon engaging with an article received in the engaging aperture, wherein the engaging portions comprise an end opposite the engaging edge, wherein the second main panel for forming the lower layer comprises an opening having a radius of curvature generally equal to the radius of curvature of a notional circle coinciding with the end of each of the engaging portions.

8. A blank for forming an article carrier, the blank comprising:

an engaging aperture having at least one engaging edge;

a first main panel for forming an upper layer of the article carrier;

a second main panel for forming a lower layer of the article carrier;

wherein the first main panel and the second main panel are arranged to be disposed in face to face contacting relationship with each other when formed as the article carrier;

wherein the engaging aperture is provided in the first main panel for forming the upper layer, wherein an article receiving opening is formed in the second main panel for forming the lower layer, wherein the article receiving opening of the second main panel comprises a first diameter, wherein the engaging aperture of the first main panel comprises a second diameter, wherein the first diameter is greater than the second diameter, wherein each engaging edge is defined between a pair of notches, the first main panel comprising a plurality of notches defining a notional circle in tangential contact with each of the plurality of notches, wherein the notional circle is concentric with the engaging aperture, wherein the engaging aperture comprises at least two engaging edges respectively provided by at least two engaging elements, wherein the at least two engaging elements are separated from each other by one of the notches and a portion of each notch is curved.

9. A blank according to claim 8 wherein the at least two engaging elements comprise either: (i) at least two teeth, or (ii) at least two non-tooth engaging elements.

10. A blank according to claim 8 wherein the at least two engaging elements comprise at least one tooth and at least one non-tooth engaging element.

11. A package comprising an article carrier and one or more cans, the article carrier comprising an engaging panel having an upper panel and a lower panel disposed in face to face contacting relationship with each other, the article carrier comprising a top engaging device comprising a first article receiving opening in the lower panel and a second article receiving opening in the upper panel, the first article receiving opening comprising a first diameter, the second article receiving opening comprising a second diameter, the first diameter being greater than the second diameter, the one or more cans comprising an upper end having an end diameter, a main body having a body diameter and a neck disposed therebetween and having a neck diameter, wherein the first diameter is equal to or greater than the end diameter, wherein the end diameter is greater than the neck diameter and wherein the neck diameter is greater than the second diameter.

12. A package according to claim 11 wherein the body diameter is greater than at least one of: (i) the first diameter, and (ii) the end diameter.

13. A package according to claim 11 wherein the second article receiving opening comprises an engaging edge defining an engaging region about at least a portion of the perimeter of the second article receiving aperture and wherein a peripheral region of the upper panel along the engaging edge is displaced out of the plane of the upper panel so as to slope upward toward the article.

14. An article carrier for packaging one or more articles, the article carrier comprising an upper panel having a first area and a lower panel having a second area disposed in face to face contacting relationship with each other, the article carrier comprising a top engaging device comprising a first article receiving opening in the lower panel and a second article receiving opening in the upper panel, wherein the upper panel comprises a plurality of notches and the second article receiving opening comprises an engaging edge defined between a pair of the notches, wherein the plurality of notches define a notional circle in tangential contact with an endpoint of each of the plurality of notches, wherein the notional circle is concentric with a circle corresponding to the second article receiving opening, wherein the first article receiving opening has a first diameter, the circle corresponding to the second article receiving opening has a second diameter, the first diameter being greater than the second diameter, and wherein the second area of the lower panel is greater than or equal two one-half of the first area of the upper panel.

15. An article carrier according to claim 14 wherein the upper panel is hingedly connected with the lower panel by a hinged connection.

16. An article carrier according to claim 14 wherein the lower panel comprises a pair of lower panel portions each hingedly connected to the upper panel by a respective hinged connection, wherein one of the pair of lower panel portions either: (i) at least partially overlaps with the other one of the pair of lower panel portions or (ii) mates with the other one of the pair of lower panel portions such that a notional line in a longitudinal direction of the article carrier intersects at least a portion of each of the pair of lower panel portions.

17. An article carrier according to claim 14 wherein the second article receiving opening comprises one or more teeth each having the engaging edge for engaging with an article, the one or more teeth being provided in a peripheral region of the upper panel about the second article receiving opening so as to define a toothed region in at least a portion of the perimeter of the second article receiving opening.

18. An article carrier according to claim 14 comprising a handle structure comprising a handle opening and a tab hingedly connected to one of the upper and lower panels by a hinged connection, wherein the upper and lower panels are formed from a substrate comprising a grain direction, wherein the hinged connection is oriented either substantially perpendicular to the grain direction or substantially parallel to the grain direction.

19. An article carrier according to claim 14 comprising a handle structure including; a recess in a first panel portion, a projection extending from a second panel portion, and a handle opening defined at least in part in the projection, wherein the projection is disposed in overlapping arrangement with the first panel portion such that the handle opening is in vertical alignment with the recess.

* * * * *